US008505900B2

(12) United States Patent
Urano

(10) Patent No.: US 8,505,900 B2
(45) Date of Patent: Aug. 13, 2013

(54) SHEET POST-PROCESSING APPARATUS AND IMAGE FORMING APPARATUS

(75) Inventor: Yuri Urano, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 13/005,038

(22) Filed: Jan. 12, 2011

(65) Prior Publication Data

US 2011/0176891 A1 Jul. 21, 2011

(30) Foreign Application Priority Data

Jan. 20, 2010 (JP) ..... 2010-009840

(51) Int. Cl.
*B31F 1/10* (2006.01)

(52) U.S. Cl.
USPC ..... 270/45; 270/32; 270/58.07

(58) Field of Classification Search
USPC ..... 270/32, 45, 58.07; 493/406, 407, 493/442, 454
See application file for complete search history.

(56) References Cited

U.S. PATENT DOCUMENTS

| | | | | |
|---|---|---|---|---|
| 6,692,208 | B1 | 2/2004 | Watkiss et al. | |
| 7,147,598 | B2 * | 12/2006 | Fujimoto et al. | 493/405 |
| 7,997,571 | B2 * | 8/2011 | Iguchi et al. | 270/45 |
| 2008/0315483 | A1 * | 12/2008 | Iguchi et al. | 270/20.1 |
| 2009/0036287 | A1 * | 2/2009 | Kawaguchi et al. | 493/442 |
| 2009/0200725 | A1 * | 8/2009 | Tamura et al. | 270/45 |
| 2010/0119276 | A1 * | 5/2010 | Sasahara et al. | 399/407 |
| 2011/0103919 | A1 * | 5/2011 | Furuhashi et al. | 412/1 |

* cited by examiner

*Primary Examiner* — Leslie A Nicholson, III
(74) *Attorney, Agent, or Firm* — Fitzpatrick, Cella, Harper & Scinto

(57) ABSTRACT

The present invention provides a sheet post-processing apparatus for performing squaring processing of a spine in a well-looking manner without leaving "wrinkles" on back portion of booklet and an image forming apparatus including such a sheet post-processing apparatus.
It is a characteristic feature thereof that when squaring of the spine by reciprocating the pressing unit along the spine of the booklet by the moving unit is performed, the distance from the spine of the booklet prior to squaring by the pressing unit to the pressing position is changed by the changing portion such that the distance of a backward movement of reciprocating the pressing unit becomes larger than the distance of a forward movement.

14 Claims, 26 Drawing Sheets

SHEET POST-PROCESSING APPARATUS AND IMAGE FORMING APPARATUS

BACKGROUND OF THE INVENTION

1. Field of the Invention

The present invention relates to a sheet post-processing apparatus for squaring a spine of a sheet bundle and an image forming apparatus including the same. More particularly, it relates to a sheet post-processing apparatus for dressing up a booklet by performing squaring of a spine of a saddle stitch bound booklet.

2. Description of the Related Art

Conventionally, when sets of approximately more than 20 sheets are folded in one lump sum, booklet is obtained that apparently has a curve adjacent to the spine. When such booklet is folded, an end portion on an opposite side of the spine will instantly open so that such booklet has poor-looking appearance. Moreover, since such booklet cannot be kept in flat conditions, it is hard to stack a plurality of booklets.

To address this issue, an apparatus and a method for pressing a curved spine of booklet and angularly deforming the spine 2*a*1 for squaring is suggested in U.S. Pat. No. 6,692,208. According to the technique of U.S. Pat. No. 6,692,208, as illustrated in FIG. 24A, a spine 2*a*1 of a booklet 2*a* is set to the leading position to be conveyed by conveying units 706, 707, and the spine 2*a*1 of the booklet 2*a* is struck by a positioning unit 705 for positioning the same. The booklet 2*a* is then pinched by holding units 702, 703 for fixing, the positioning unit 705 is retracted, and a pressing roller 704 allows the booklet to run along the spine 2*a*1 while applying pressure to the spine 2*a*1 of the booklet 2*a*. In this manner, the curved spine 2*a*1 undergoes squaring. FIG. 24B is a pattern diagram illustrating a running and moving direction A of the pressing roller 704, wherein the pressing roller 704 is retracted to an area in which it does not contact the booklet 2*a* until the booklet 2*a* is pinched by the holding units 702, 703. When the booklet 2*a* is pinched and fixed, the roller moves from one end to the other end of the booklet 2*a* while applying pressure to the spine 2*a*1.

However, according to the technique of U.S. Pat. No. 6,692,208, the pressing roller 704, including rotating members, rotates and presses the spine 2*a*1 of the booklet 2*a* that is held by the holding units 702, 703 while it moves along the spine 2*a*1 such that the back portion of the booklet 2*a* is deformed and squared. While the booklet 2*a* is held by the holding units 702, 703 when the spine 2*a*1 of the booklet 2*a* is pressed by the pressing roller 704, the pressing surface of the booklet 2*a* is pushed downstream of the running and moving direction A of the pressing roller 704. Therefore, as illustrated in FIG. 24C, wrinkles C are generated on the booklet 2*a* in oblique directions between points that are held by the holding units 702, 703 and the pressing surface that has been pushed downstream by the pressing roller 704 such that the appearance is worsened.

At this time, directions of the wrinkles C vary depending on the moving direction of the pressing roller 704, and the larger the pressing amount of the pressing roller 704 at the spine 2*a*1 of the booklet 2*a* is, the larger the pressing force of the pressing roller 704 becomes. Here, the pressing amount of the pressing roller 704 is distance from spine 2*a*1 prior to squaring up to a pressing surface of the pressing roller 704 when squaring processes is performed the spine 2*a*1. Accordingly, the pressing surface of the booklet 2*a* is easily pushed downstream of the running and moving direction A of the pressing roller 704 so that generation of wrinkles becomes strongly apparent. For restricting opening of the end portion opposite of the spine 2*a*1 so as to keep the booklets 2*a* in flat conditions and to stack a plurality of booklet 2*a* necessitates reliable squaring so that it is necessary to set a large pressing amount for the pressing roller 704 at the spine 2*a*1 of the booklet 2*a*. Accordingly, when the roller is pressed at the predetermined pressing amount, wrinkles C are generated so as to worsen the appearance of the booklet 2*a*.

The present invention accordingly aims to solve the subject of squaring spine in a good-looking manner without leaving "wrinkles" on back portions of booklet.

SUMMARY OF THE INVENTION

A representative arrangement of the sheet post-processing apparatus according to the present invention includes a holding unit that holds a booklet containing folded sheets, a pressing unit having a pressing surface that presses a spine of booklet held by the holding unit and that performs squaring of the spine, a moving unit that moves the pressing unit along the spine, and a changing portion that changes a pressing position at the pressing surface of the pressing unit in a pressing direction with respect to the spine of the booklet, wherein when squaring of the spine by reciprocating the pressing unit along the spine of the booklet by the moving unit is performed, the distance from the spine of the booklet prior to squaring by the pressing unit to the pressing position is changed by the changing portion such that the distance of a backward movement of reciprocating the pressing unit becomes larger than the distance of a forward movement thereof.

According to the present invention, when switching between back and forward moving directions of the pressing unit, the pressing unit is moved by the changing portion from a pressing position when a forward movement of the pressing unit to a pressing position when a backward movement at which the distance in the pressing direction between the spine prior to squaring to the pressing position is larger than that when forward movement. With this arrangement, the spine that has been pushed downstream in the running and moving direction of the pressing unit when a forward movement is pushed back when a backward movement so that wrinkles that have been generated on the back portions of the booklet when a forward movement can be eliminated.

Further features of the present invention will become apparent from the following description of exemplary embodiments with reference to the attached drawings.

DESCRIPTION OF THE EMBODIMENTS

In the following, exemplary embodiments of the present invention will be described with reference to the drawings.

First Embodiment

Figure 1:
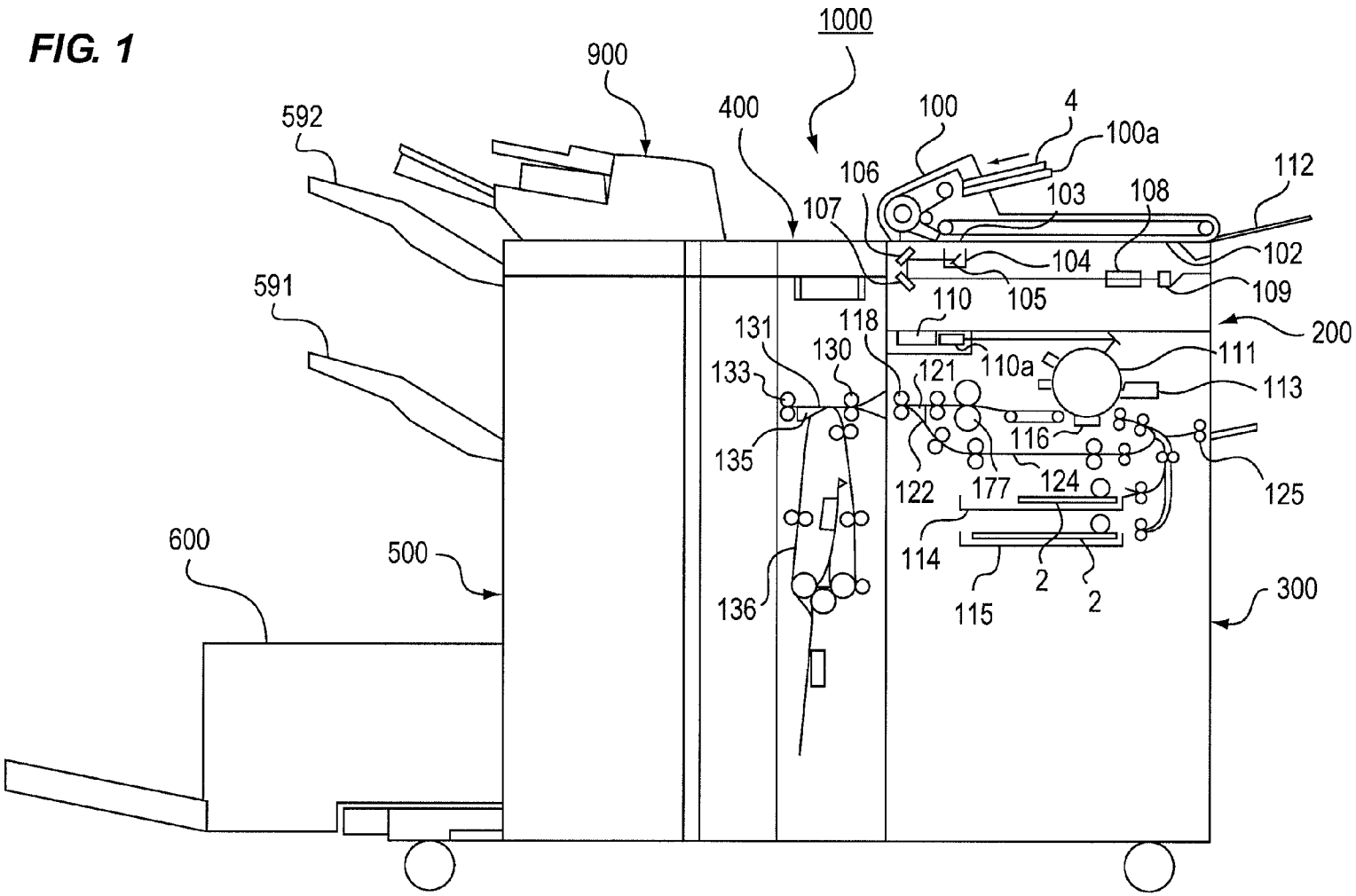
FIG. 1 is a sectional explanatory view illustrating an arrangement of a copying apparatus including the sheet post-processing apparatus according to the present invention.
Figure 2:
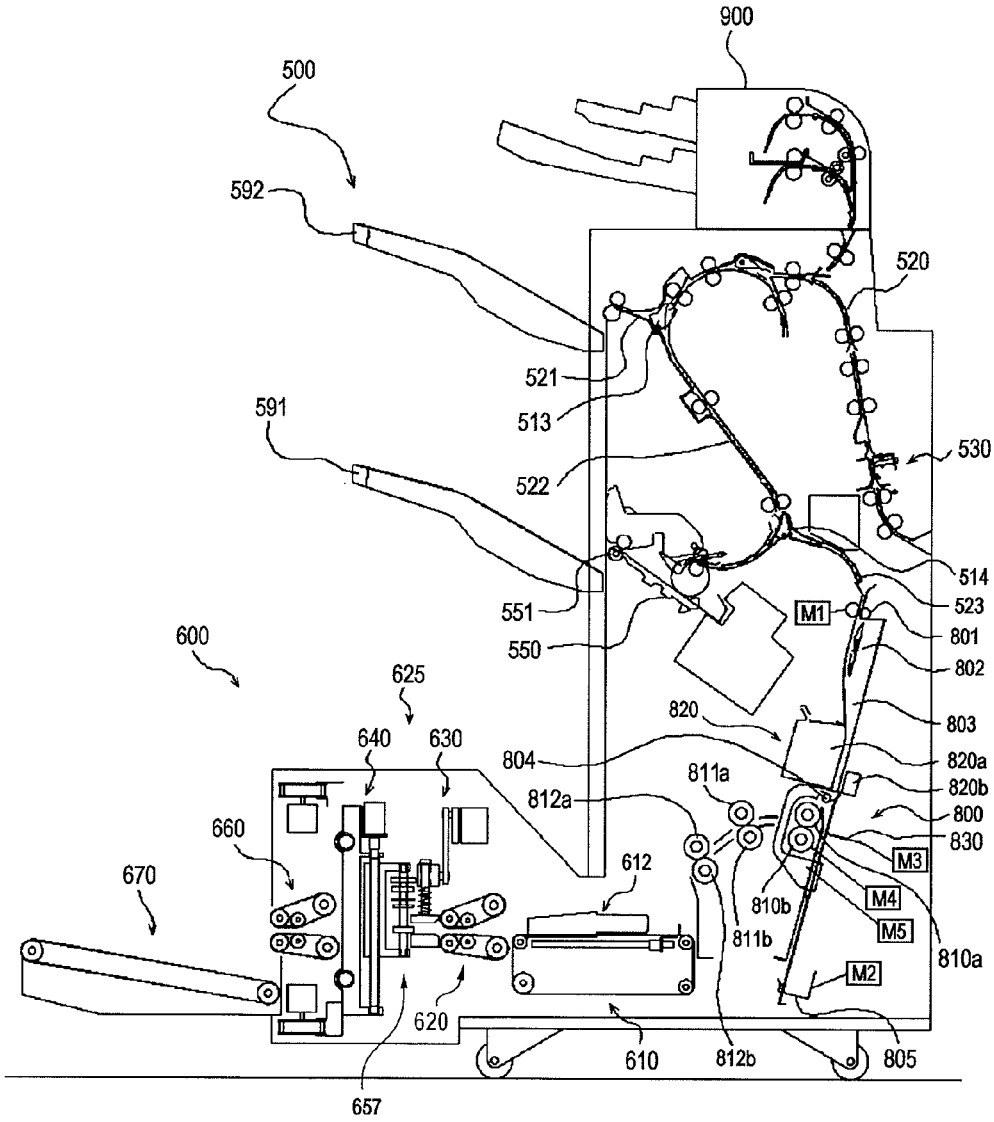
FIG. 2 is a sectional explanatory view illustrating an arrangement of a bookbinding apparatus of a first embodiment of the sheet post-processing apparatus according to the present invention.

A main part of a first embodiment of the sheet post-processing apparatus according to the present invention is illustrated in FIG. 2. FIG. 1 is a sectional explanatory view illustrating an inner configuration of a copying apparatus 1000 that includes an image forming apparatus to which the sheet processing apparatus according to the present invention is applicable. The copying apparatus 1000 includes, among others, a document feeding portion 100, an image reader portion 200, a printer portion 300, a folding processing portion 400, a finisher 500, a saddle stitch binding portion 800, a squaring processing portion 600 and an inserter 900. The folding processing portion 400, the saddle stitch binding portion 800, the squaring processing portion 600 and the inserter 900 can be provided as optional portions.

Referring to FIG. 1, a document 4 set onto a document tray 100*a* of the document feeding portion 100 is conveyed in a leftward direction (direction of the arrow in FIG. 1) by the document feeding portion 100 page by page in turn from the topmost page. The document 4 is further conveyed via a curved conveying path over a platen glass 102 from the left to right in FIG. 1 to be then discharged onto a discharge tray 112. In this respect, a scanner unit 104 is in a condition in which it is maintained in a predetermined position, wherein reading processing of the document 4 is performed when the document 4 passes over the scanner unit 104 from left to right in FIG. 1. When the document 4 passes over the platen glass 102, the document 4 is irradiated by a lamp 103 of the scanner unit 104 whereupon reflected light from the document 4 is guided over mirrors 105, 106, 107 and lens 108 to an image sensor 109 including an image reading unit.

Image data of the document 4 that has been read by the image sensor 109 undergoes specific image processing before they are sent to an exposure controlling portion 110. The exposure controlling portion 110 outputs laser light corresponding to image signals. The laser light is irradiated onto a photosensitive drum 111 being an image bearing member while being scanned by a polygon mirror 110*a*. An electrostatic latent image corresponding to the scanned laser light is formed on the photosensitive drum 111.

The electrostatic latent image formed on the photosensitive drum 111 is developed by a development device 113 and is made visible as a toner image. On the other hand, a recording sheet (hereinafter simply referred to as "sheet") 2 is conveyed from any one of sheet cassettes 114, 115, a manual feeding portion 125 and a duplex conveying path 124 to a transfer portion 116 constituting an image forming portion together with the photosensitive drum 111 and the development device 113. The visualized toner image is then transferred onto the sheet 2 in the transfer portion 116. The transferred sheet 2 undergoes fixing processing in a fixing portion 177.

After passing the fixing portion 177, the sheet 2 is guided first to the conveying path 122 by means of a switching flapper 121, and when a rear end of the sheet 2 has escaped the switching flapper 121, the sheet 2 is switched back to be conveyed to a discharge roller 118 by means of the switching flapper 121. The sheet 2 is then discharged from the printer 300 by the discharge roller 118. With this arrangement, the sheet 2 can be discharged from the printer portion 300 in a face-down condition in which the surface on which the toner image is formed faces down. This is referred to as reverse discharge.

As mentioned above, by discharging the sheet 2 out from the apparatus in a face-down manner, it is possible to justify the page order when performing image forming processes in turns from the topmost page. It is, for instance, possible to justify the page order in case of performing image forming processes by using the document feeding portion 100 or in case of performing image forming processes using image data from a computer.

Next, the arrangement of the finisher 500 will be described with reference to FIGS. 1 and 2. The folding processing portion 400 includes a conveying path 131 for introducing the sheet 2 that has been discharged from the printer portion 300 and for guiding the same towards the finisher 500 side. A pair of conveying rollers 130, 133 is provided on the conveying path 131. A switching flapper 135 provided near the pair of conveying rollers 133 is for guiding the sheet that has been conveyed by the pair of conveying rollers 130 to a folding path 136 or towards the finisher 500 side. The folding processing portion 400 stacks and folds a plurality of sheets 2 into two.

The finisher 500 introduces the sheet 2 that has been conveyed from the printer portion 300 via the folding processing portion 400. The sheet 2 is then processed in, for instance, a process of adjusting a plurality of introduced sheets 2 and bundling it into a single bundle of sheet 2, a stapling process (binding process) of stapling a rear end side of the bundle of sheets 2, a sorting process or a non-sorting process.

As illustrated in FIG. 2, the finisher 500 includes a conveying path 520 for introducing the sheets 2 that have been conveyed via the folding processing portion 400 into the apparatus, wherein the conveying path 520 includes a plurality of pairs of conveying rollers.

A punch unit 530 is provided midstream of the conveying path 520, wherein the punch unit 530 performs operations, as appropriate, and performs a punching (perforating) process at a rear end portion of the conveyed sheet 2.

The switching flapper 513 provided at a terminal of the conveying path 520 is provided for switching the path between an upper discharge path 521 and a lower discharge path 522 that are connected downstream. The upper discharge path 521 performs discharge to an upper stack tray 592. On the other hand, the lower discharge path 522 performs discharge to a processing tray 550. The sheets 2 that are discharged to the processing tray 550 are stored in bundles while being sequentially aligned, and according to settings by the operation portion 1, sorting processes or stapling processes are performed whereupon the sheets are discharged to the upper and lower stack trays 591, 592 by means of a pair of bundle discharge rollers 551.

The arrangement of the saddle stitch binding portion 800 will now be described. The sheet 2 that has been switched to the right-hand side in FIG. 2 by means of a switching flapper 514 provided midstream of the lower discharge path 522 passes through a saddle discharge path 523 to be sent to the saddle switching binding portion 800. The sheets 2 are passed over to a pair of saddle inlet rollers 801, and upon selection of a conveying inlet according to sheet sizes by a switching flapper 802 that operates by means of a solenoid, the sheets are conveyed into a storage guide 803 of the saddle stitch binding portion 800. The conveyed sheets 2 are conveyed by a slide roller 804 until their tip ends abut a movable sheet positioning member 805. The pair of saddle inlet rollers 801 and the slide roller 804 are driven by a driving motor M1. A stapler 820 is provided at a midstream position of the storage guide 803 that is located opposite to the storage guide 803. The stapler 820 is divided into a driver 820*a* for extruding needles and an anvil 820*b* for bending the extruded needles. In this respect, the sheet positioning member 805 is arranged in that when conveying the sheets 2, a central portion thereof in a sheet conveying direction terminates at a position that is to be the fastening position of the stapler 820. The sheet positioning member 805 is freely movable upon being driven by a driving motor M2 and its position is variable according to sheet sizes.

A pair of folding rollers 810*a*, 810*b* is provided on a downstream side of the stapler 820, and an extruding member 830 is provided at a position opposing the pair of folding rollers 810*a*, 810*b*. A home position of the extruding member 830 is a position in which it is retracted from the storage guide 803. By extruding the extruding member 830 towards the bundle of sheets 2 stored by driving a driving motor M3, the bundle of sheets 2 is folded while being pressed into a nip of the pair of folding rollers 810*a*, 810*b*. The extruding member 830 then returns to its home position. In this respect, pressing force F1 sufficient to crease the bundle of sheets 2 is applied between the pair of folding rollers 810*a*, 810*b* by means of a spring (not illustrated). The creased bundle of sheets 2 is discharged to a booklet receiving portion 610 via a first pair of folding and conveying rollers 811*a*, 811*b* and a second pair of folding and conveying rollers 812*a*, 812*b*.

Figure 3:
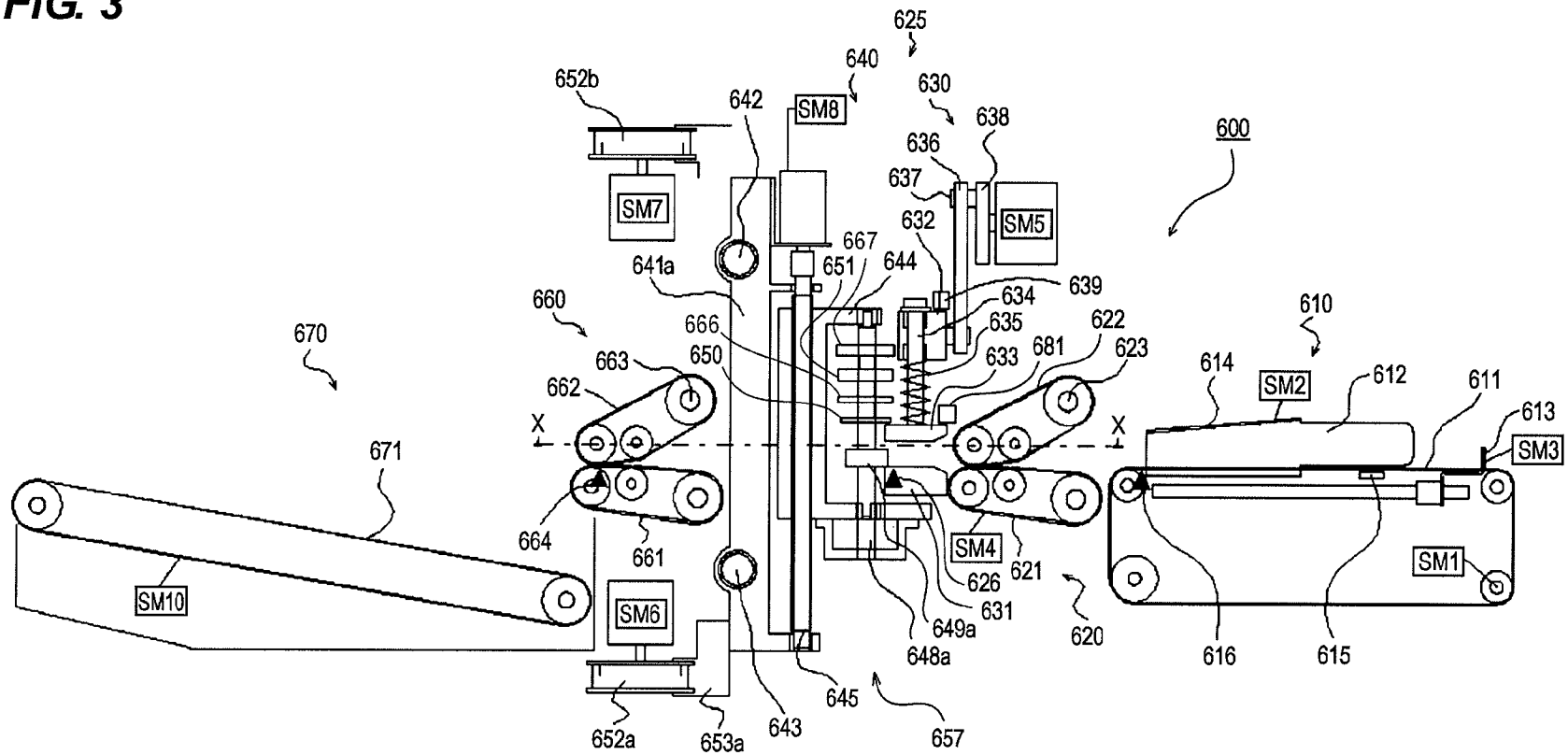
FIG. 3 is sectional explanatory view illustrating an arrangement of the first embodiment of the sheet post-processing apparatus according to the present invention.

The squaring processing portion 600 will now be described with reference to FIG. 3. The squaring processing portion 600 is located downstream (on the left hand in FIG. 2) of the saddle stitch binding portion 800. FIG. 3 is an enlarged view of the squaring processing portion 600 of FIG. 2. In FIG. 3, the booklet 2*a* receiving portion 610 includes a lower conveying belt 611 of which only the lower side extends in a booklet conveying direction for receiving and conveying the booklet 2*a* obtained by bookbinding the folded sheets 2 from the saddle stitch binding portion 800. Since the lower conveying belt 611 rotates in a booklet conveying direction (from a right-hand to a leftward direction in FIG. 3) when receiving the booklet 2*a*, the booklet 2*a* will not rotate even if the booklet 2*a* fall from the second pair of folding and conveying rollers 812*a*, 812*b*, and the booklet can be received in a posture of conveyance as it is.

A pair of side guides 612 is disposed on each outer side of the lower conveying belt 611 which operate in width directions of the booklet 2*a* to correct the positions of the booklet 2*a* in width directions. Further, a fastening guide 614 for preventing opening of the booklet 2*a* is formed on the upper side of the pair of side guides 612 that functions as a guide for smoothly transferring the booklet 2*a* to a downstream portion in the booklet conveying direction. Moreover, transport claws 613 that move in parallel with the lower conveying belt 611 are disposed on both sides of the lower conveying belt 611. The transport claws 613 perform forward and reverse movements at substantially the same velocity as that of the lower conveying belt 611. In the event slip occurs between the lower conveying belt 611 and the booklet 2*a*, the transport claws 613 contact with rear ends of the booklet 2*a* to reliably press the rear ends of the booklet 2*a* into a downstream side in the booklet conveying direction. In this respect, the lower conveying belt 611, the pair of side guides 612 and the transport claws 613 operate upon being driven by driving motors SM1, SM2 and SM3, respectively.

An inlet conveying portion 620 includes a lower conveying belt 621 and an upper conveying belt 622 for receiving the booklet 2*a* from the booklet receiving portion 610 and for conveying them to a downstream side in the booklet conveying direction. The upper conveying belt 622 is arranged to rotate around a fulcrum 623 to follow thicknesses of the booklet 2*a* and is pressed towards the lower conveying belt 621 by means of a spring (not illustrated). The upper and lower conveying belts 621, 622 are driven by a driving motor SM4. A booklet receiving inlet detecting sensor 615 receives the booklet 2*a* from the saddle stitch binding portion 800 and detects that a booklet 2*a* exists on the lower conveying belt 611. By detecting a booklet 2*a*, a detection signal of a booklet receiving outlet detecting sensor 616 will serve as an input signal for actuating the pair of side guides 612 and the transport claws 613.

A squaring processing portion 625 includes a fastening unit 630 for fastening a proximity of the spine **2*a*1 of the booklet 2*a* from the top and bottom and a squaring unit 640 for positioning the spine 2*a*1 of the booklet 2*a* and for pressing the spine 2*a*1**.

The fastening unit 630 is divided into an upper portion including an upper fastening plate 633 that performs a vertical movement and a lower fastening plate 631 that is fixed to a frame while opposing the upper fastening plate 633. In other words, the upper and lower fastening plates 631, 633 include a holding unit for holding the booklet **2*a* containing folded sheets 2. The upper portion including the upper fastening plate 633 includes a firm fastening base 632 that is driven by a driving motor SM5 for performing a vertical movement via links 636, 637 and 638 and the upper fastening plate 633 coupled by a slide coupling member 634. A compression spring 635 is disposed on an outer periphery of the slide coupling member 634. When the fastening base 632 is at the upper position, the upper and lower fastening plates 631, 633 are separated from each other and the booklet 2*a* is conveyed therebetween. Further, when the fastening base 632 is at the lower portions, the booklet 2*a* is firmly pressed and held by the upper and lower fastening plates 631, 633 by means of a compression spring 635 that expands and contracts according to thicknesses of the booklet 2*a*. Since contact surfaces of the upper and lower fastening plates 631, 633 at which they contact the booklet 2*a* is flat and smooth without protrusions, no pressing imprints are formed on the booklet 2*a* when the booklet 2*a* is pressed and held. An upper dead center detecting sensor 639 detects that the fastening base 632 is at the upper position. A booklet thickness detecting sensor 681 detects a position of the upper fastening plate 633 when a booklet 2*a* is fixed for detecting the thickness of the booklet 2*a***.

Figure 4:
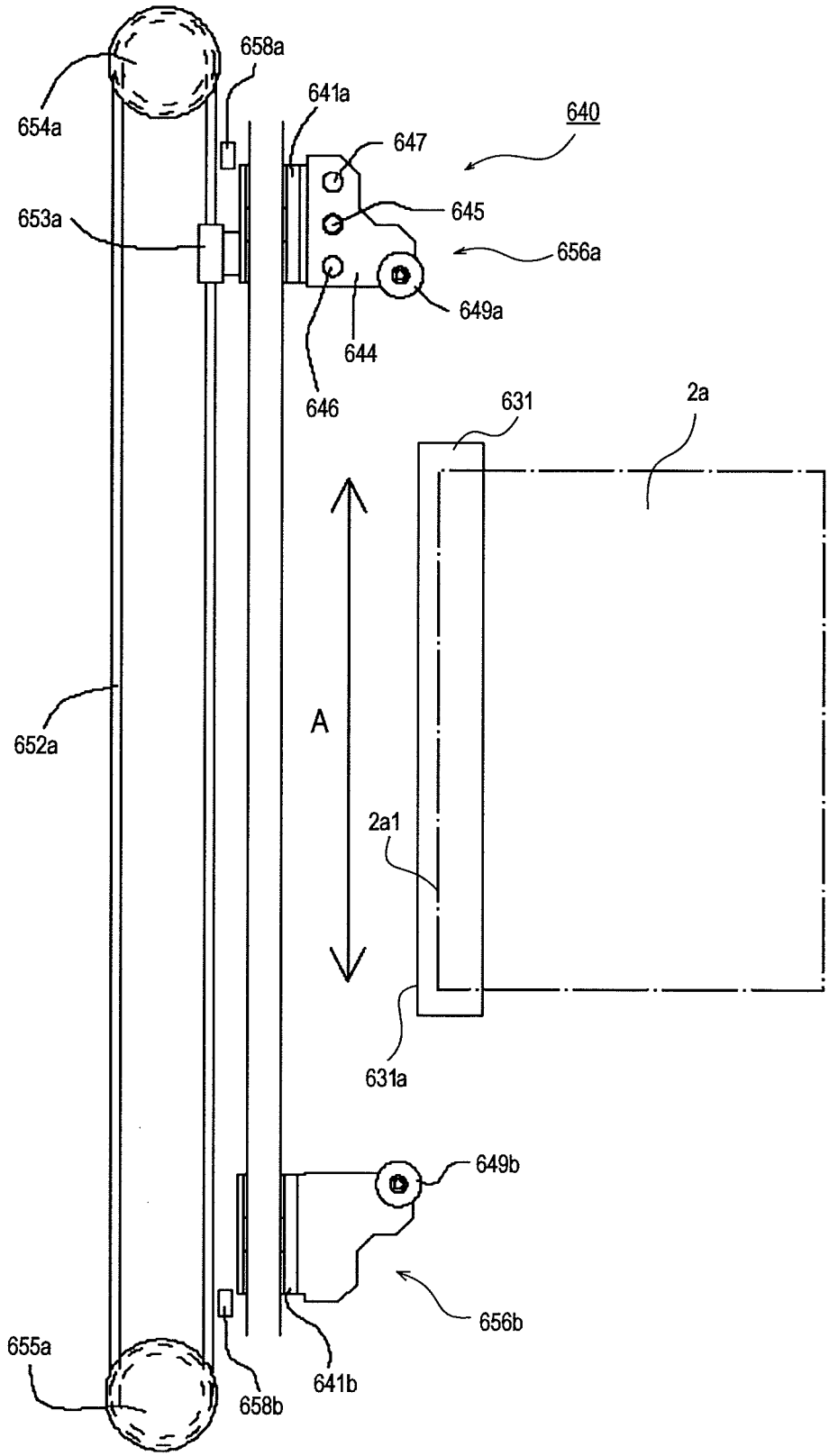
FIG. 4 is a plan explanatory view illustrating an arrangement of a squaring unit of the first embodiment.
Figure 5:
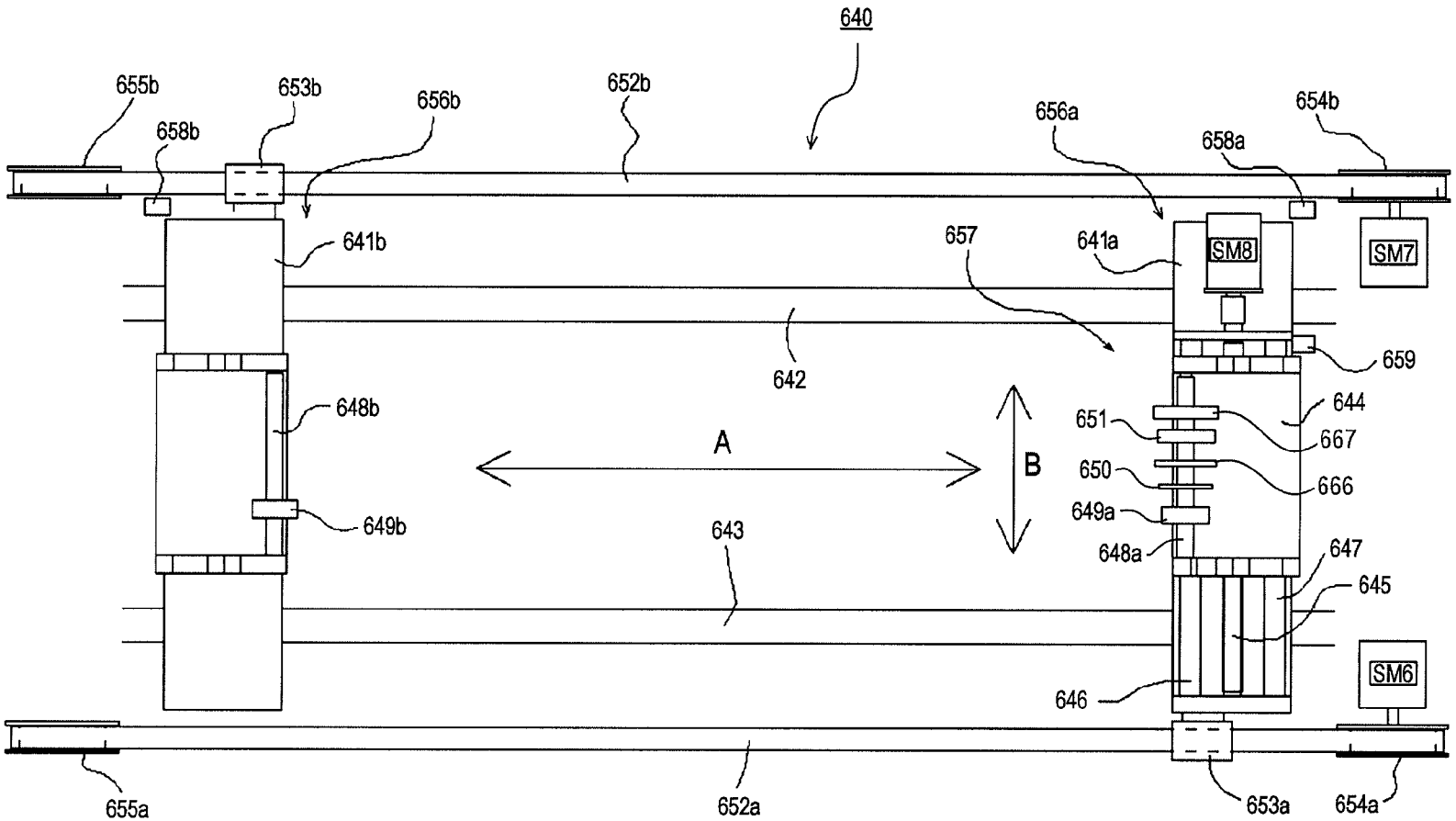
FIG. 5 is a side explanatory view illustrating an arrangement of the squaring unit of the first embodiment.

The squaring unit 640 will now be described with reference to FIGS. 3, 4 and 5. FIG. 4 is a view seen in a direction of line X-X in FIG. 3, and FIG. 5 is a view illustrating the squaring unit 640 of FIG. 3 seen from the right-hand side. The squaring unit 640 is provided with a moving unit **656*a* illustrated in FIG. 5. The moving unit 656*a* is supported to be freely reciprocating in a running and moving direction A in FIGS. 4 and 5 along slide shafts 642, 643 supported at a framework (not illustrated). The moving unit 656*a* is mounted to a timing belt 652*a* by means of a coupling member 653*a* and is driven by a driving motor SM6 via pulleys 654*a*, 655*a***.

The moving unit **656*a* includes a moving base 641*a* and supports a switching unit 657 for switching the pressing member at slide shafts 646, 647 fixed at the moving base 641*a* in a slidable manner. The switching unit 657 is movable in a direction of arrow B in FIG. 5 along the slide shafts 646, 647 by means of a slide screw 645 and a driving motor SM8. A support shaft 648*a* is rotatably mounted to a switching base 644 of the switching unit 657. A stopper member 649*a*, a first pressing member 650, a second pressing member 651, a third pressing member 666 and a fourth pressing member 667 are fixed at the support shaft 648*a*. The first pressing member 650, the second pressing member 651, the third pressing member 666 and the fourth pressing member 667 are rotating members of respectively different diameters. The first pressing member 650, the second pressing member 651, the third pressing member 666 and the fourth pressing member 667 are a pressing unit having a pressing surface for pressing the spine 2*a*1 of the booklet 2*a* held by the upper and lower fastening plates 631, 633 being the holding unit to perform squaring processes of the spine 2*a*1. The first pressing member 650, the second pressing member 651, the third pressing member 666 and the fourth pressing member 667 are further configured as a plurality of pressing members of different pressing positions in pressing directions with respect to the spine 2*a*1 (from left to right in FIGS. 6C to 6F, from left to right in FIGS. 7C to 7F and from left to right in FIGS. 8C to 8F). In addition, a pressing position is a position of a pressing surface of the pressing unit when squaring processes is performed the spine 2*a*1. And a pressing direction is a direction orthogonal to the direction along the spine 2*a*1 to press a top of the spine 2*a*1**.

A stopper member **649*a* is a member that cooperates with a stopper member 649*b* (to be described later) and that positions the spine 2*a*1 at a position for performing squaring processes when the spine 2*a*1 of the conveyed booklet 2*a* abut against the stopper. The first pressing member 650, the second pressing member 651, the third pressing member 666 and the fourth pressing member 667 are members for pressing the spine 2*a*1 of the booklet 2*a* for performing squaring processes. Then, by moving a switching unit 657 for switching the plurality of pressing members in the direction of arrow B in FIG. 5 depending on the thickness of the booklet 2*a*, suitable switching of the first pressing member 650, the second pressing member 651, the third pressing member 666 and the fourth pressing member 667 is performed. The switching unit 657 is provided with a reference position detecting sensor 659 that indicates a reference position when moving in the direction of arrow B in FIG. 5**.

The squaring unit 640 is further provided with a moving unit **656*b*. The moving unit 656*b* is supported to be movable in the running and moving direction A in FIGS. 4 and 5 along slide shafts 642, 643 that are supported at a framework (not illustrated). The moving unit 656*b* is mounted to a timing belt 652*b* by means of a coupling member 653*b* and is driven by a driving motor SM7 via pulleys 654*b*, 655*b***.

The moving unit **656*b* includes a moving base 641*b*, wherein a support shaft 648*b* is rotatably mounted to the moving base 641*b*, and a stopper member 649*b* is fixed to the support shaft 648*b*. The stopper member 649*b* is a member that cooperates with the stopper member 649*a* and that positions the booklet 2*a* at a position for performing squaring processes with the spine 2*a*1 of the conveyed booklet 2*a*** abutting against the stopper.

Figure 6E:
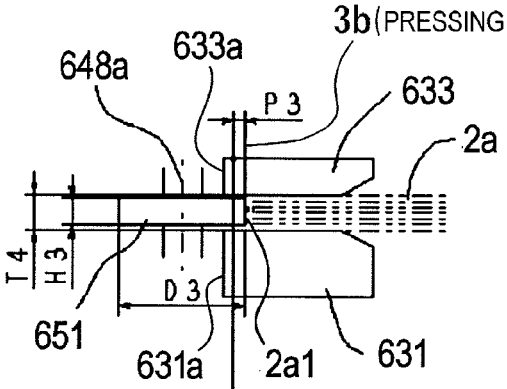
FIG. 6 is a diagram describing arrangements of stopper members and respective pressing members of the first embodiment.
Figure 6F:
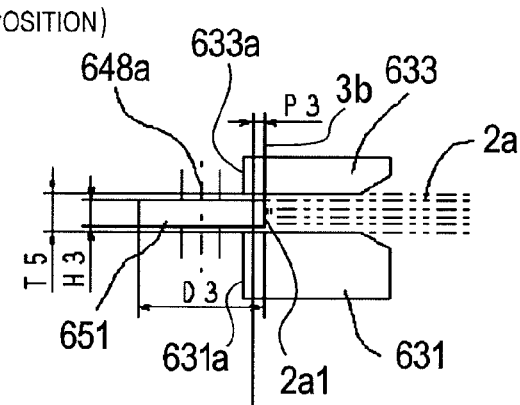
Figure 6C:
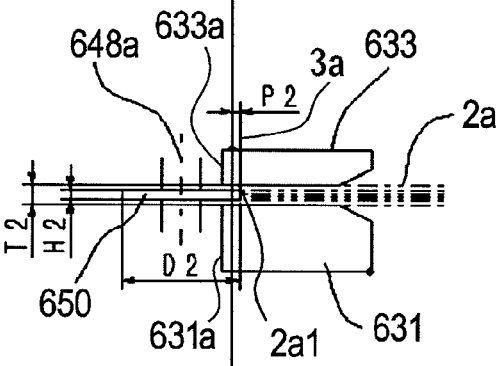
Figure 6D:
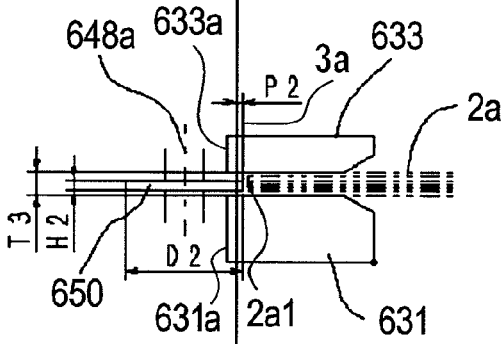
Figure 6A:
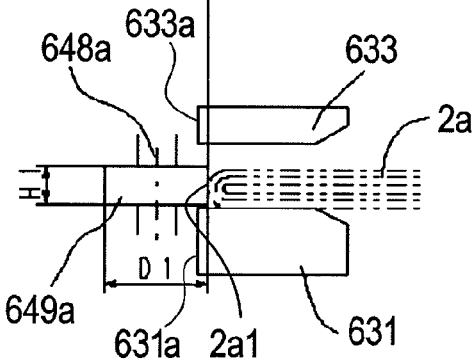
Figure 6B:
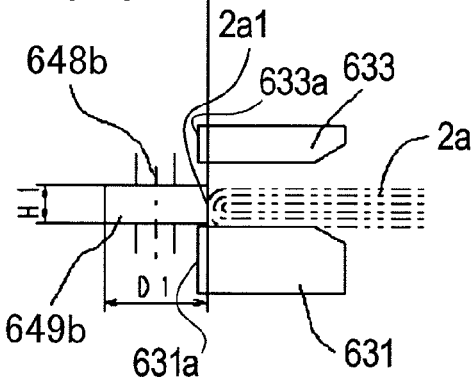
Figure 7E:
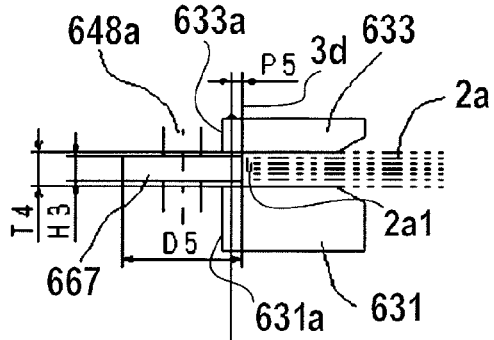
FIG. 7 is a diagram describing arrangements of stopper members and respective pressing members of the first embodiment.
Figure 7F:
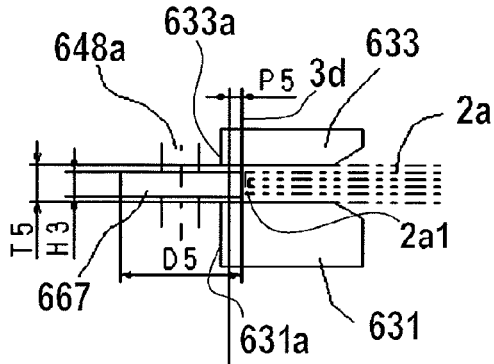
Figure 7C:
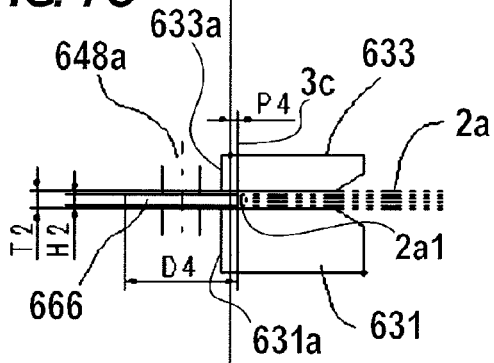
Figure 7D:
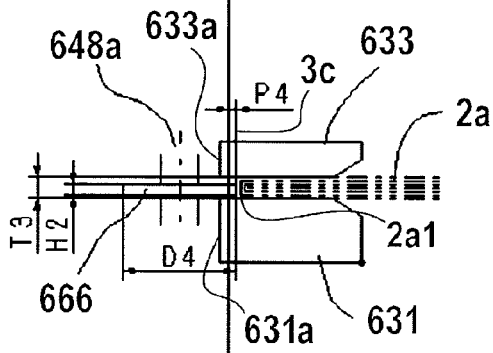
Figure 7A:
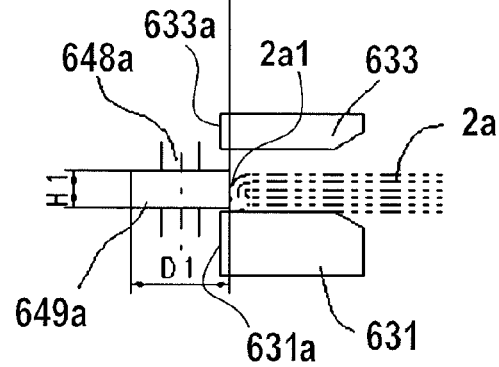
Figure 7B:
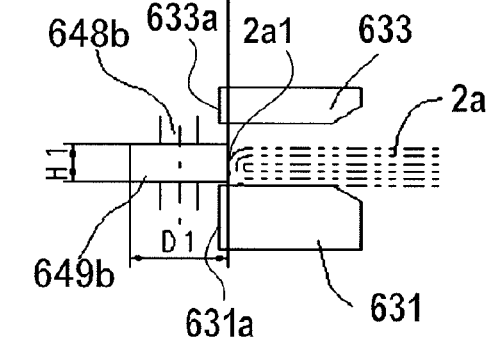

The moving unit **656*a* is configured as a moving unit for moving the first pressing member 650, the second pressing member 651, the third pressing member 666 and the fourth pressing member 667 being a pressing unit that is suitably switched by the switching unit 657 along the spine 2*a*1 of the booklet 2*a*. The moving unit 656*a* and the moving unit 656*b* are respectively provided with reference position detecting sensors 658*a*, 658*b* that indicate a reference position when moving in the direction of arrow A in FIG. 5. All of the stopper members 649*a*, 649*b*, the first pressing member 650, the second pressing member 651, the third pressing member 666 and the fourth pressing member 667 have a disk-like shape and their relations between outer diameter and height are as indicated in FIGS. 6 to 8. As illustrated in FIGS. 6A and 6B, the diameter of the stopper members 649*a*, 649*b* is D1. The stopper members 649*a*, 649*b* enter into the clearance between the upper and inner fastening plates 631, 633 for positioning the booklet 2*a* at positions at which they do not project from end portions 631*a*, 633*a* of the upper and lower fastening plates 631, 633 on the downstream side in the booklet conveying direction. More particularly, the upper and lower fastening plates 631, 633** being the holding unit hold the spine 2a1 of the folded booklet 2a without the spine 2a1 projecting out from the holding surfaces of the upper and lower fastening plates 631, 633. The height of the stopper members 649a, 649b is H1 and higher than the thickness of the booklet 2a being conveyed so that even in cases of the booklet 2a of large thickness, spine 2a1 can be positioned without the spine 2a1 crossing over the stopper members 649a, 649b.

The booklet 2a that are created by the saddle stitch binding portion 800 of the present embodiment are the booklet 2a that range from the booklet 2a containing a single two-folded sheet 2 to the booklet 2a containing 25 two-folded sheets 2. Settings are made such that among these, the booklet 2a whose number of two-folded sheets 2 is 1 to 10 do not undergo squaring processes while the booklet 2a whose number of two-folded sheets 2 is 11 to 25 undergo squaring processes. The booklet 2a containing two-folded sheets 2 by a number of 1 to 10 have a small booklet thickness. It is accordingly hard to secure processing regions in the pressing direction for performing squaring of the spine 2a1 (pressing amount; distance from the spine 2a1 prior to squaring up to the pressing positions 3a to 3d as illustrated in FIGS. 6 to 8). Moreover, the amount of bulging of the booklet 2a does not change through squaring processes. While the booklet 2a containing two-folded sheets 2 by a number of 11 to 25 undergo squaring processes in the present embodiment, the thicknesses of the booklet 2a vary. It is therefore the case that the thickness of the booklet 2a is divided into two stages, wherein when the thickness of the booklet 2a is from T2 to T3 as illustrated in FIGS. 6C to 6F, it is switched to the first pressing member 650 of a height H2 to perform a forward movement of the squaring processes. When the thickness of the booklet 2a is from T4 to T5, it is switched to the second pressing member 651 of a height H3 to perform a forward movement of the squaring processes. In this respect, the relationship of the thicknesses of the booklet 2a is given by {T2<T3<T4<T5}, and the relationship of the heights of the third pressing member 666 and the fourth pressing member 667 is given by {H2<H3}.

The relationship of the diameter D1 of the stopper members 649a, 649b, the diameter D2 of the first pressing member 650 and the diameter D3 of the second pressing member 651 is given by {D1<D2<D3}. In case of the first pressing member 650 that is used for performing squaring of the booklet 2a that are relatively thin, the processing region (pressing amount; the distance between the spine 2a1 prior to squaring processes up to the pressing position 3a illustrated in FIGS. 6C, 6D and 8C) is given by P2=(D2−D1)/2. In case of the second pressing member 651 that is used for performing squaring of the thick booklet 2a, the processing region (pressing amount; the distance between the spine 2a1 prior to squaring processes up to the pressing position 3b illustrated in FIGS. 6E, 6F and 8D) is given by P3=(D3−D1)/2. In the present embodiment, the processing region (pressing amount; distance from spine 2a1 prior to squaring up to the pressing position 3b) P3 for the thick booklet 2a is set to be larger when compared to the processing region (pressing amount; distance from spine 2a1 prior to squaring up to the pressing position 3a) P2 for the thin booklet 2a (P2<P3). In this manner, the processing region in the pressing direction of squaring processes (pressing amount; distance from spine 2a1 prior to squaring up to the pressing position 3) P is not a positioning position for the booklet 2a set by the stopper members 649a, 649b. More particularly, the distance P in the pressing direction that is to be the processing region in the pressing direction of squaring processes is set depending on the size of each diameter D of the first pressing member 650, the second pressing member 651, the third pressing member 666 and the fourth pressing member 667.

Figure 16:
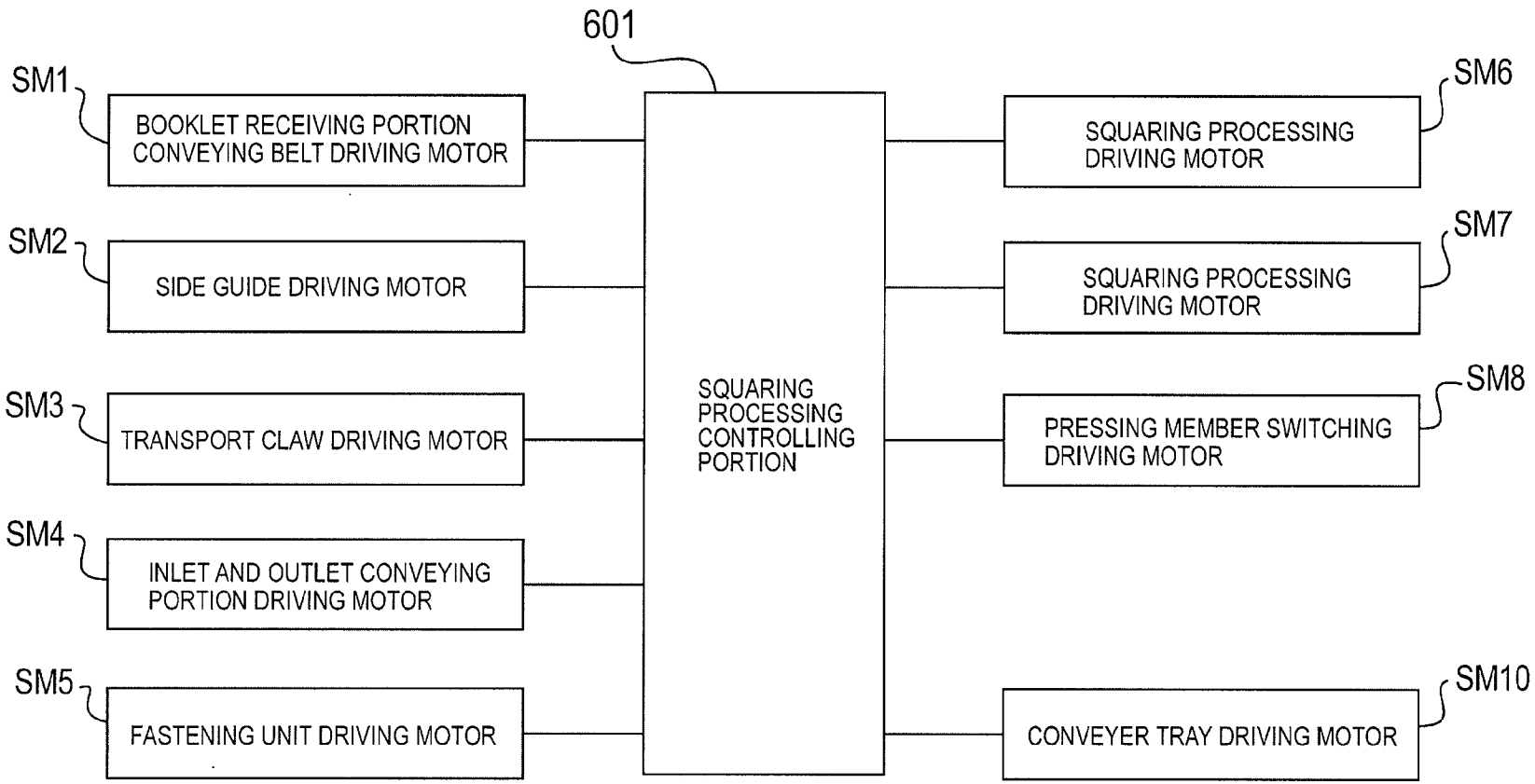
FIG. 16 is a block diagram of a driving system of the first embodiment of the sheet post-processing apparatus according to the present invention.

Further, the first pressing member 650, the second pressing member 651, the third pressing member 666 and the fourth pressing member 667 constituting the pressing unit are suitably switched and reciprocated by the moving unit 656a as illustrated in FIG. 5 along the spine 2a1 of the booklet 2a. When performing squaring processes of the spine 2a1 of the booklet 2a, the distances P of the booklet 2a prior to squaring by the pressing units from the spine 2a1 in the pressing direction to the pressing positions 3 is changed such that the distances P in the pressing direction when the pressing units perform a backward movement become larger than the distances P in the pressing direction when they perform a forward movement. More particularly, the driving motor SM8 is driven by a squaring processing controlling portion 601 that is to be the changing portion as illustrated in FIG. 16 for rotating a slide screw 645 as illustrated in FIG. 3 in a predetermined direction. The switching base 644 is then moved in vertical directions in FIG. 3 for suitably switching and changing among the first pressing member 650, the second pressing member 651, the third pressing member 666 and the fourth pressing member 667. The squaring processing controlling portion 601 that is to be the changing member suitably switches, by using the switching unit 657, among the first pressing member 650, the second pressing member 651, the third pressing member 666 and the fourth pressing member 667 that is to be the pressing member. With this arrangement, the pressing positions 3a to 3d in the pressing direction of the pressing surface of the pressing unit (respective outer peripheral surfaces of the first pressing member 650, the second pressing member 651, the third pressing member 666 and the fourth pressing member 667) with respect to the spine 2a1 of the booklet 2a is changed.

In this manner, when performing a backward movement of squaring processes in a direction opposite to the moving direction of forward movement, it is switched to the third pressing member 666 having a height H2 when the thickness of the booklet 2a is from T2 to T3 as illustrated in FIGS. 7C to 7F. When the thickness of the booklet 2a is T4 to T5, it is switched to the fourth pressing member 667 of height H3.

Figure 8E:
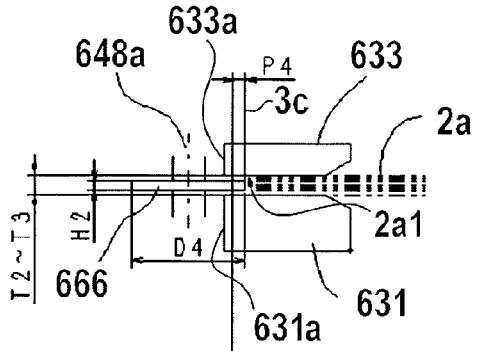
FIG. 8 is a diagram describing arrangements of stopper members and respective pressing members of the first embodiment.
Figure 8F:
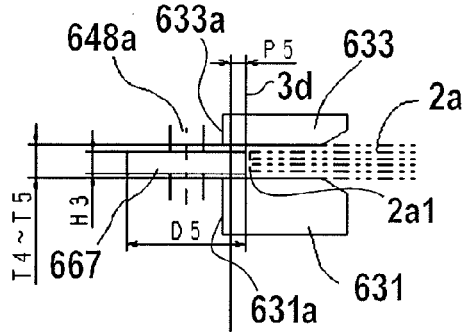
Figure 8C:
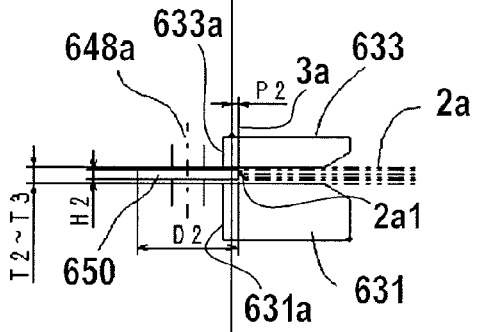

As shown in FIGS. 8(c) and (e), the first pressing member 650 and the third pressing member 666 are of the same height H2, and the respective diameters D2, D4 of the first and third pressing members 650, 666 satisfy a relationship of {D2<D4}. The squaring processing regions (pressing amount; distance from the spine 2a1 in the pressing direction (lateral directions in FIG. 8) prior to squaring processing to the pressing positions 3a, 3c) P2, P4 satisfy P2=(D2−D1)/2 in case of the first pressing member 650 and P4=(D4−D1)/2 in case of the third pressing member 666. With this arrangement, settings are made such that the distance P4 in the pressing direction that is to be the processing region when performing a backward movement becomes larger than the distance P2 in the pressing direction that is to be the processing region when performing a forward movement (P2<P4). In this respect, the distance P2 in the pressing direction that is to be the processing region when performing a forward movement and the distance P4 in the pressing direction that is to be the processing region when performing a backward movement are respectively the distance from the spine 2a1 of the booklet 2a in the pressing direction prior to squaring processing up to the pressing positions 3a, 3c.

Figure 8D:
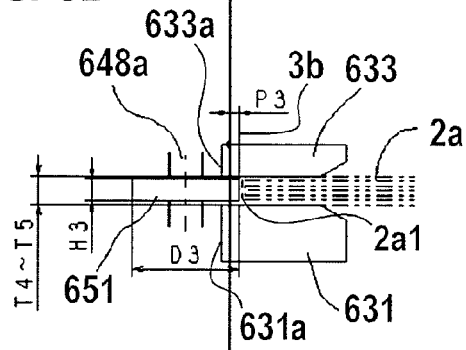
Figure 8A:
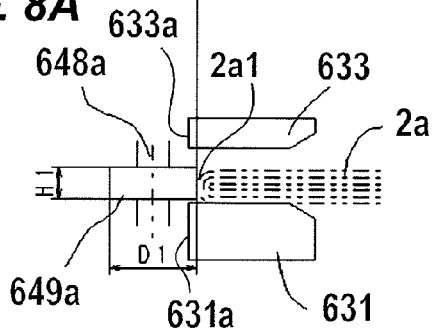
Figure 8B:
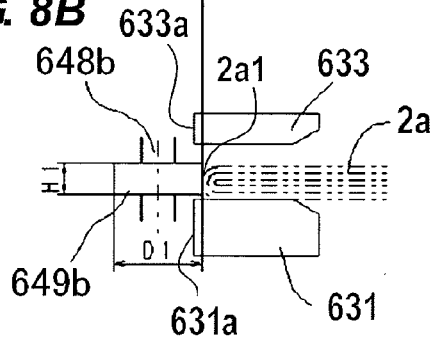

Similarly, as illustrated in FIGS. 8D and 8F, the second pressing member 651 and the fourth pressing member 667 are of the same height H3, and the respective diameters D3, D5 of the second pressing member 651 and the fourth pressing member 667 respectively satisfy a relationship of {D3<D5}. The squaring processing regions (pressing amount; distance from the spine 2*a*1 in the pressing direction (lateral directions in FIG. 8) prior to squaring processing to the pressing positions 3*b*, 3*d*) P3, P5 satisfy P3=(D3−D1)/2 in case of the second pressing member 651 and P5=(D5−D1)/2 in case of the fourth pressing member 667. With this arrangement, settings are made such that the distance P5 in the pressing direction that is to be the processing region when performing a backward movement becomes larger than the distance P3 in the pressing direction that is to be the processing region when performing a forward movement (P3<P5). In this respect, the distance P3 in the pressing direction that is to be the processing region when performing a forward movement and the distance P5 in the pressing direction that is to be the processing region when performing a backward movement are respectively the distance from the spine 2*a*1 of the booklet 2*a* in the pressing direction prior to squaring processing up to the pressing positions 3*b*, 3*d*.

Similar to the time when performing a forward movement, settings are made such that the distance P5 in the pressing direction that is to be the processing region for the thick booklet 2*a* becomes larger than the distance P4 in the pressing direction that is to be the processing region for the thin booklet 2*a* (P4<P5). In this respect, the distances P4, P5 in the pressing direction that are to be the processing regions are respectively the distances from the spine 2*a*1 of the booklet 2*a* in the pressing direction prior to squaring processing up to the pressing positions 3*c*, 3*d*.

The stopper members 649*a*, 649*b*, the first pressing member 650, the second pressing member 651, the third pressing member 666 and the fourth pressing member 667 are arranged such that the moving units 656*a*, 656*b* slide through the clearance between the upper and lower fastening plates 631, 633 of the fastening unit 630. With this arrangement, it is possible to reciprocate in the running and moving direction A as illustrated in FIG. 4. Then, when the moving unit 656*a* is at a position separated away from the upper and lower fastening plates 631, 633 (at a position retracted to a position at which it does not interfere the upper and lower fastening plates 631, 633), the switching unit 657 as illustrated in FIG. 3 is slid. With this arrangement, it is possible to switch a pressing member that is to be located between the upper and lower fastening plates 631, 633.

Figure 9B:
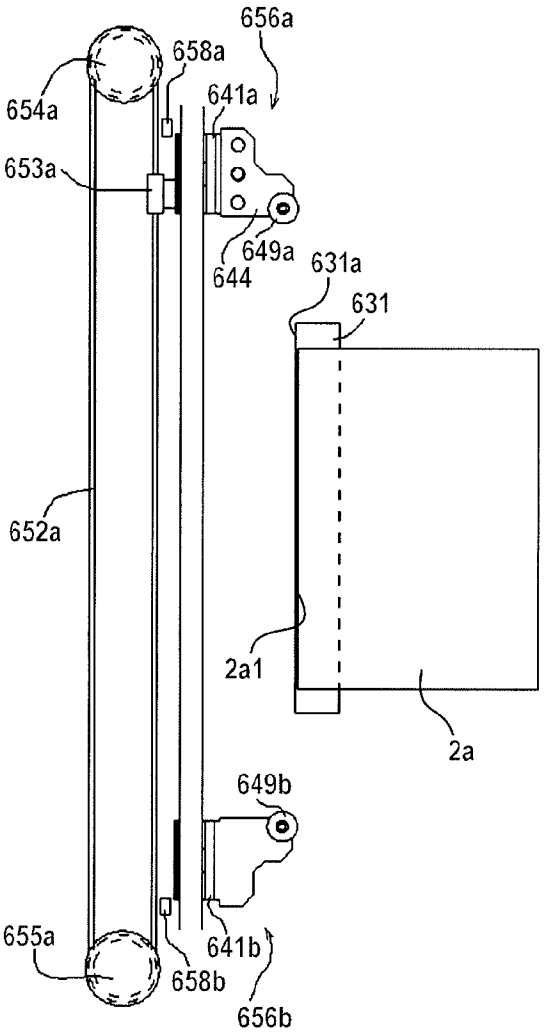
FIG. 9 is a plan explanatory view describing operations of the stopper members of the first embodiment.
Figure 9A:
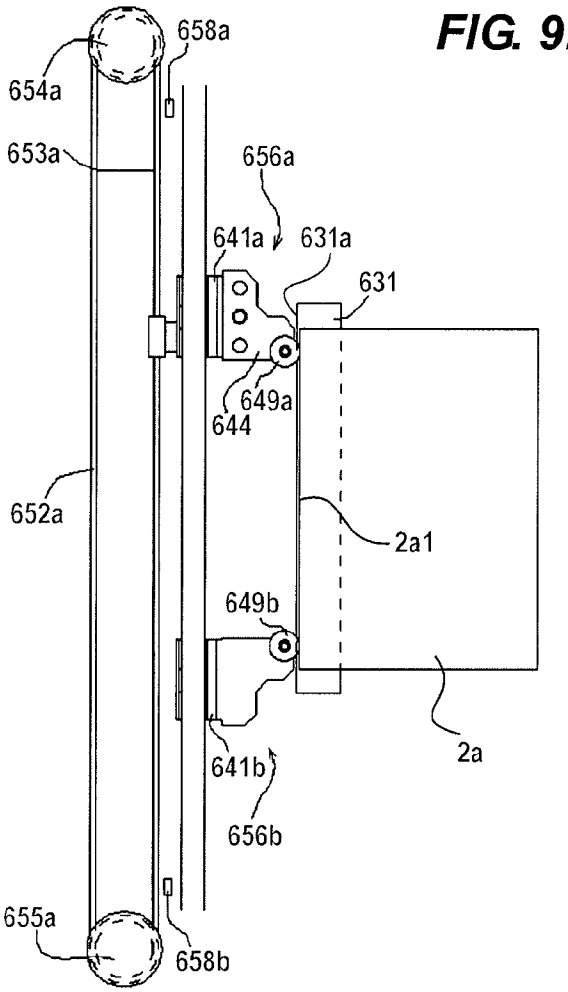

When positioning the booklet 2*a* that are sent from the inlet conveying portion 620 by the fastening unit 630, the stopper members 649*a*, 649*b* are located between the upper and lower fastening plates 631, 633 symmetric with respect to a width directional center of the booklet 2*a* and being located further inward than the width dimension of the booklet 2*a* as illustrated in FIG. 9A. With this arrangement, the spine 2*a*1 of the booklet 2*a* can be abutted and positioned. The booklet 2*a* conveyed up to the stopper members 649*a*, 649*b* are detected by a booklet positioning detecting sensor 626.

As mentioned above, the dimension of the height H1 of the stoppers 649*a*, 649*b* is set so that it is higher than the thickness of the booklet 2*a* such that the spine 2*a*1 of the thick booklet 2*a* can abut and be positioned. With this arrangement, when the stoppers 649*a*, 649*b* are positioned between the upper and lower fastening plates 631, 633, there is a relationship in that the upper fastening plate 633 cannot hold the booklet 2*a*. Therefore, as illustrated in FIG. 9B, after positioning the booklet 2*a*, the stoppers 649*a*, 649*b* are removed and retracted towards the sides of the upper and lower fastening plates 631, 633 whereupon the proximity of the spine 2*a*1 of the booklet 2*a* is pressed and held by the fastening unit 630. At this time, the spine 2*a*1 of the booklet 2*a* will not project from the end portions 631*a*, 633*a* on the downstream side in the booklet 2*a* conveying direction of the upper and lower fastening plates 631, 633. In this respect, the booklet 2*a* is nipped by the upper and lower conveying belts 621, 622 of the inlet conveying portion 620 so that the booklet 2*a* will not be misaligned. Thereafter, according to thicknesses of the booklet 2*a* detected by the booklet thickness detecting sensor 681, it is switched from the stopper member 649*a* to the first pressing member 650 or the second pressing member 651 by the switching unit 657 as illustrated in FIG. 10A. In this respect, FIG. 10A illustrates a condition in which it has been switched to the second pressing member 651.

Figure 10B:
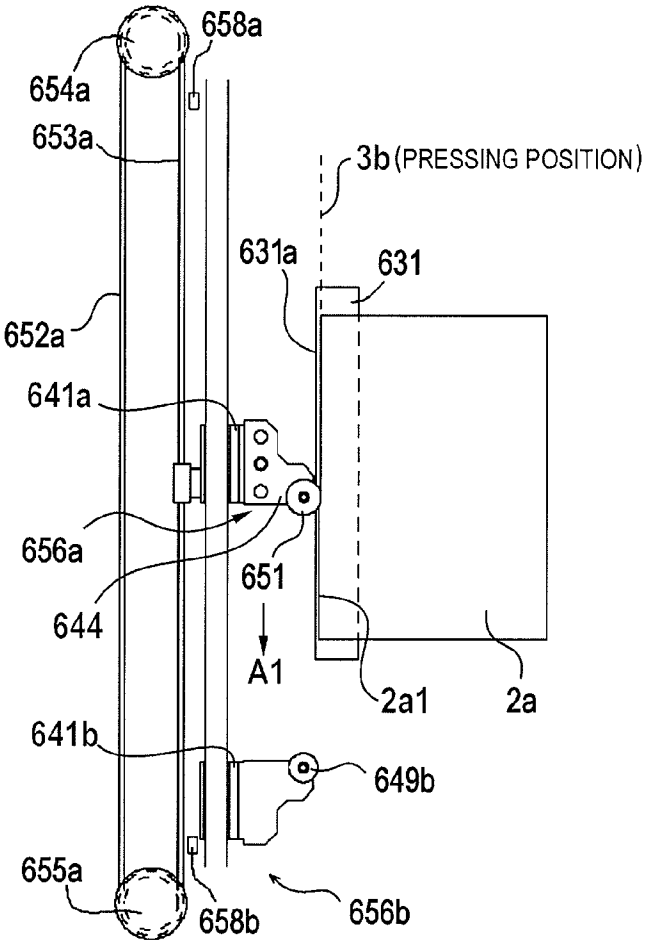
FIG. 10 is a plan explanatory view describing operations when a forward movement of the pressing member of the first embodiment.
Figure 10A:
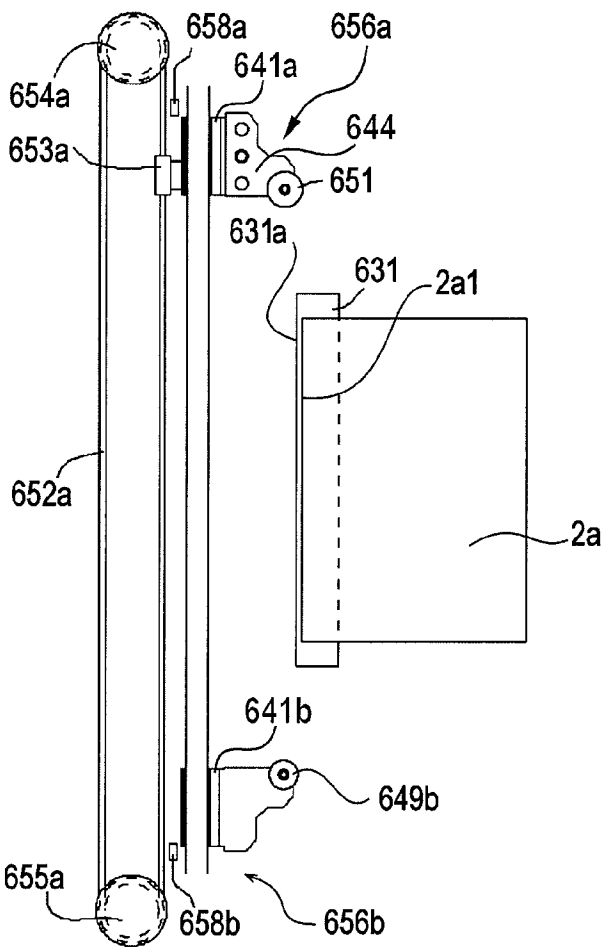
Figure 11B:
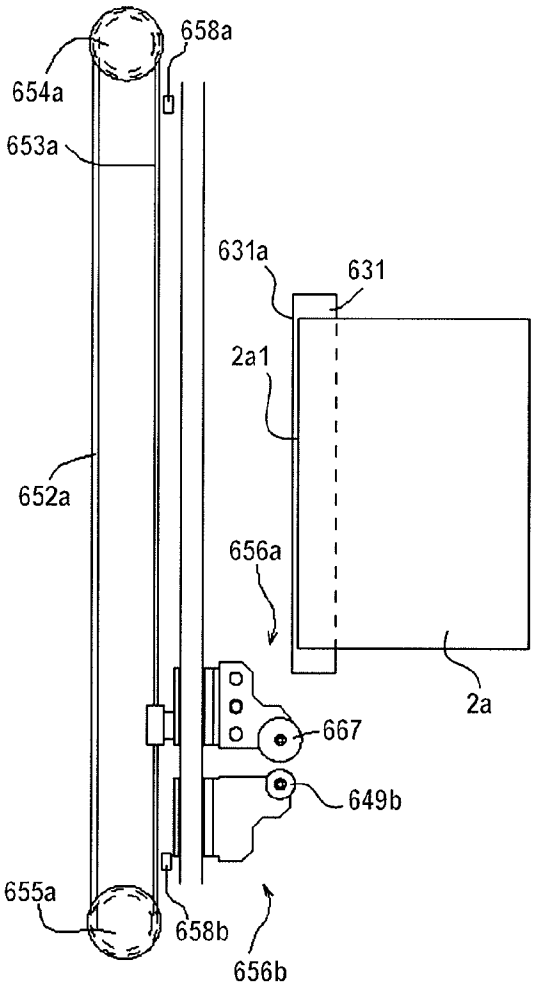
FIG. 11 is a plan explanatory view describing operations when a forward movement of the pressing member of the first embodiment.
Figure 11A:
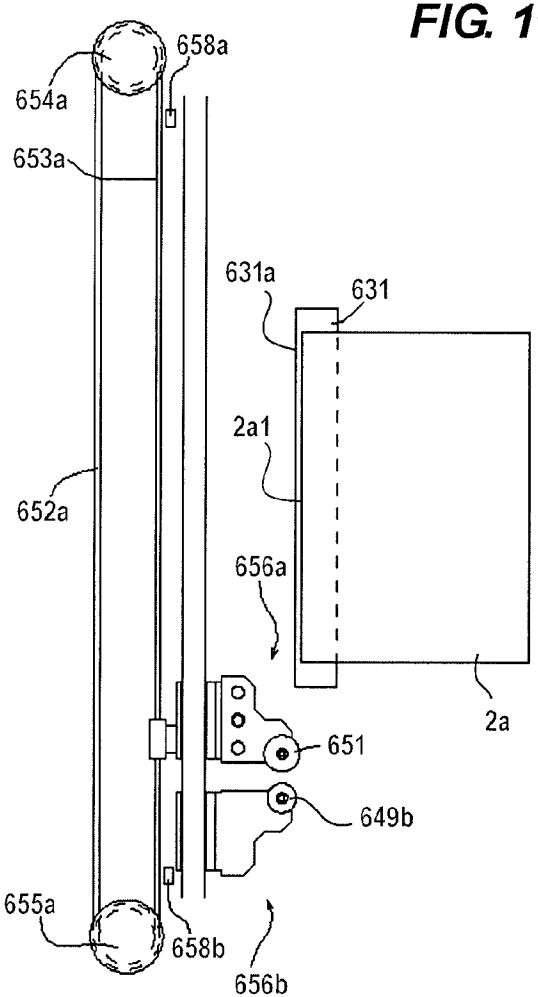
Figure 14:
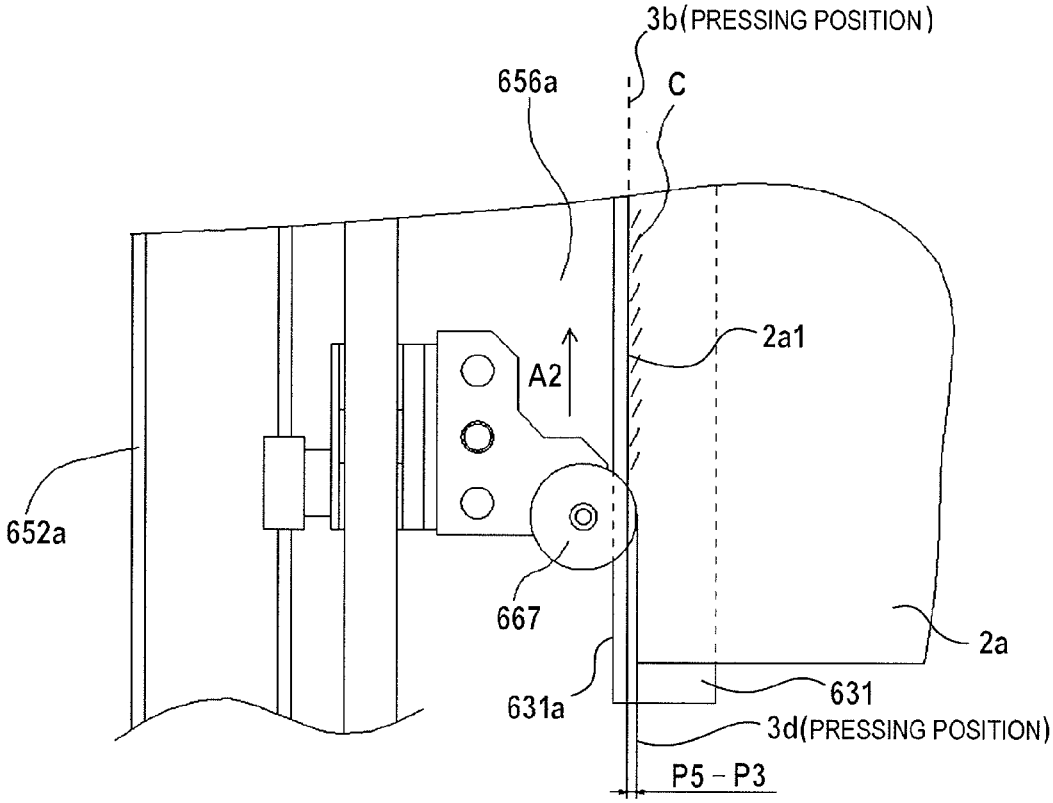
FIG. 14 is a plan explanatory view describing a condition in which the distance in the pressing direction from the spine of the booklet to the pressing position when a backward movement of the pressing member is larger than the distance when a forward movement according to the first embodiment.

Then, as illustrated in FIGS. 10B and 11A, by moving the moving unit 656*a* to the opposite side end of the booklet 2*a* in the forward moving direction A1 in FIG. 10B, the spine 2*a*1 of the booklet 2*a* can be pressed and squared. In this respect, when the second pressing member 651 that is to be the pressing unit is moved by the moving unit 656*a* in the pressing direction (lateral directions in FIG. 10B) at the pressing position 3*b* for a forward movement in one direction along a rear portion of the booklet 2*a*, wrinkles C will be generated as illustrated in FIG. 14 at this point of time. When it has been switched to the first pressing member 650 when forward movement, the pressing member is switched to the third pressing member 666 when a backward movement. Alternatively, when it has been switched to the second pressing member 651 when forward movement, it is switched to the fourth pressing member 667 when backward movement. FIG. 11B illustrates a condition in which it has been switched to the fourth pressing member 667.

Figure 12B:
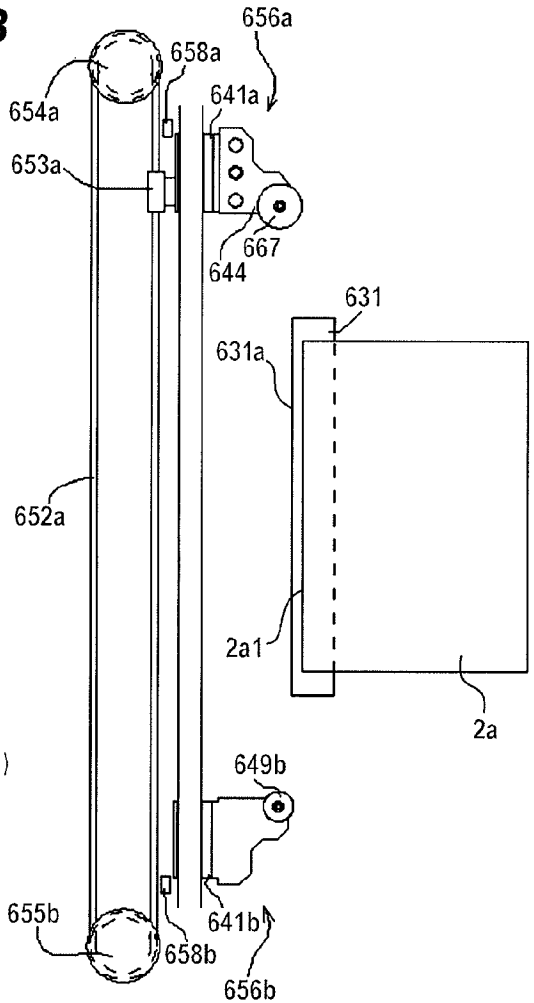
FIG. 12 is a plan explanatory view describing operations when a backward movement of the pressing member of the first embodiment.
Figure 12A:
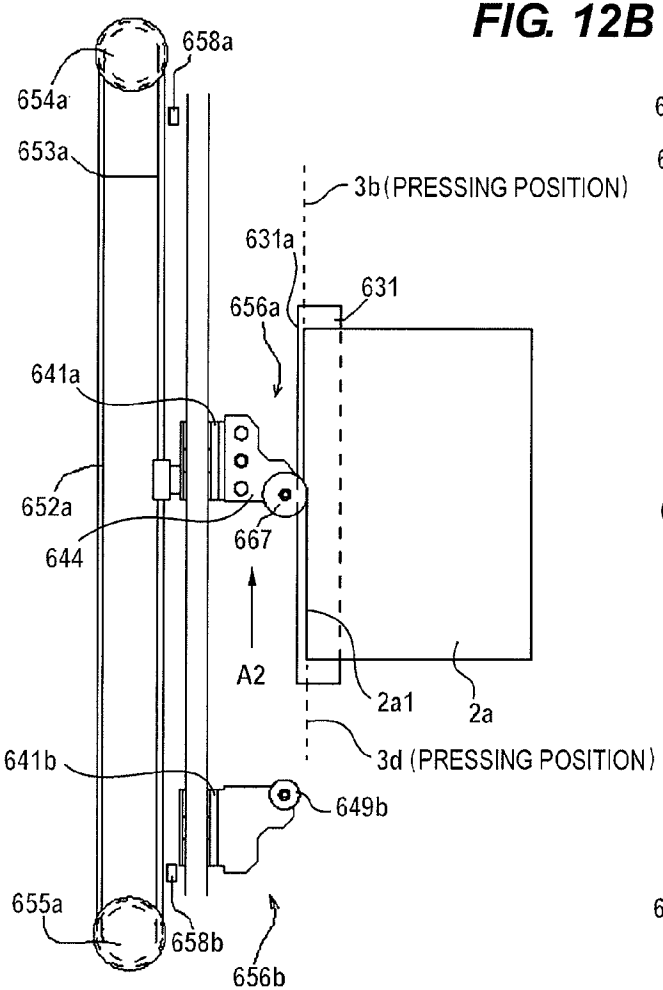
Figure 13:
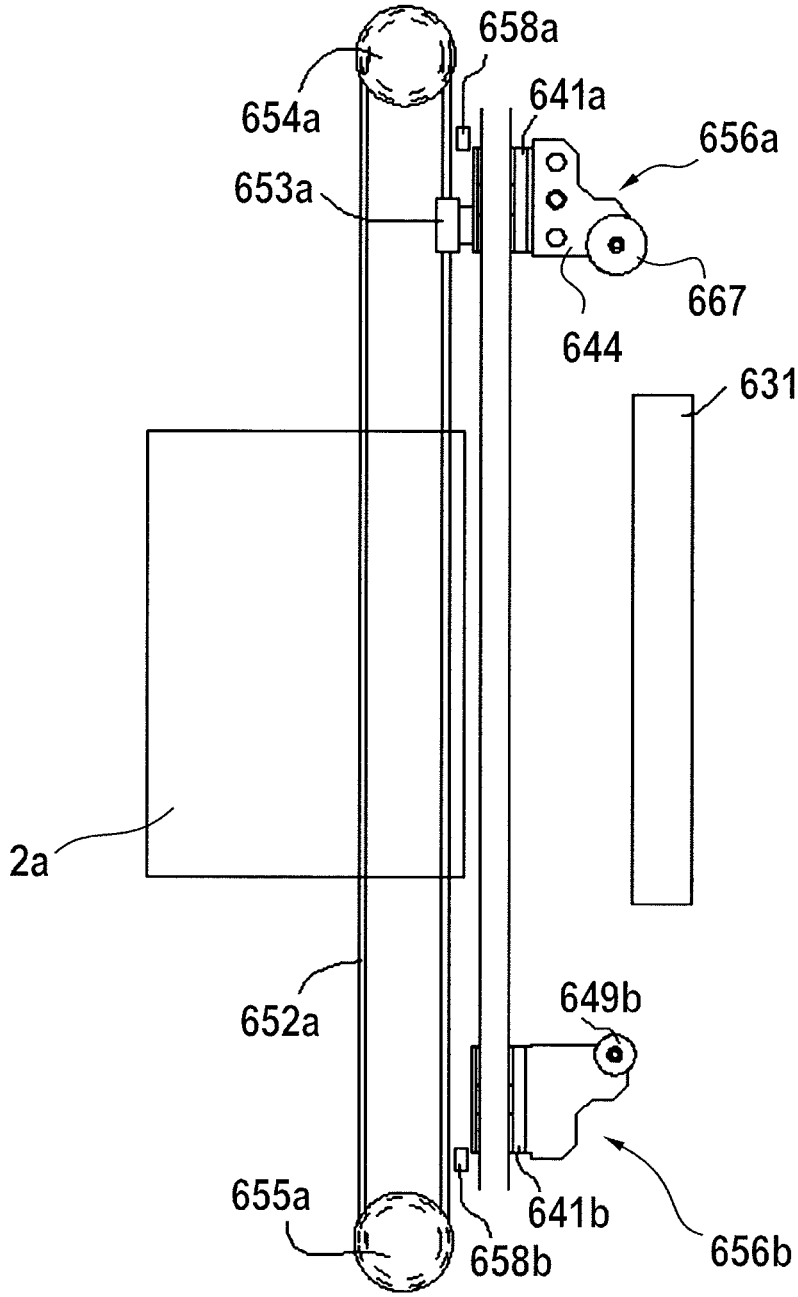
FIG. 13 is a plan explanatory view describing operations when a backward movement of the pressing member of the first embodiment.

Then, as illustrated in FIGS. 12A and B, by moving the moving unit 656*a* in a direction opposite to that when a forward movement in the backward moving direction A2 of FIG. 12A up to a side end of the booklet 2*a*, it is possible to repeatedly press and square the spine 2*a*1 of the booklet 2*a*. FIG. 14 is an enlarged view illustrating a pressing portion in which the fourth pressing member 667 of FIG. 12A abuts the spine 2*a*1 of the booklet 2*a*. As illustrated in FIG. 14, the moving unit 656*a* is moved up to the side end of the booklet 2*a* in the backward moving direction A2 when performing a backward movement. The distance from the spine 2*a*1 in the pressing direction (lateral directions in FIG. 14) prior to squaring of the previous forward movement to the pressing position 3*b* is P3. Further, the distance from the spine 2*a*1 in the pressing direction (lateral directions in FIG. 14) prior to squaring of the previous backward movement to the pressing position 3*d* is P5. The distance P5 is made larger than the distance P3 by an amount of {P5−P3}. At this time, {P5−P3>0} is satisfied. The squared booklet 2*a* is then conveyed to the downstream side in the booklet conveying direction (leftward direction in FIG. 13) as illustrated in FIG. 13.

When forward movement, the moving unit 656*a* slides and the pressing member moves in one direction along the spine 2*a*1 of the booklet 2*a*. At this time, the pressing portion of the spine 2*a*1 of the booklet 2*a* is pushed out to the downstream in the forward moving direction A1 of the moving unit 656*a* so that wrinkles C are generated proximate of the pressing portion of the spine 2*a*1 of the booklet 2*a*. However, when switching the moving direction of the moving unit 656*a* for a forward movement into the backward moving direction A2, the diameter D of the pressing member is set to be larger than the diameter D of the pressing member when forward movement. With this arrangement, the pressing position 3 is moved to a position for a backward movement in which the distance P in the pressing direction from the spine 2*a*1 prior to squaring to the pressing position 3 is large. Thereafter, pressing and moving in the backward direction A2 is performed along the spine 2a1 of the booklet 2a. With this arrangement, it is possible to return sheets when a backward movement that have been pushed downstream in the forward moving direction A1 of the moving unit 656a as illustrated in FIG. 14. Accordingly, no wrinkles will remain on the rear portion of the booklet 2a also when squaring is performed by a predetermined amount of pressing. In addition, by changing the diameter D of the pressing member, the distance P from the spine 2a1 in the pressing direction prior to squaring up to the pressing position 3 is changed when backward movement. It is therefore possible to obtain a stable pressing position 3, and the shape of the squared booklet 2a can be stabilized.

In FIG. 3, an exit conveying portion 660 includes a lower conveying belt 661 and upper conveying belt 662 that receive the booklet 2a that have been squared and released from the pressed and held condition by the fastening unit 630 and that convey the booklet 2a to the downstream side in the booklet conveying direction. The upper conveying belt 662 is arranged to rotate around a fulcrum 663 according to the thickness of the booklet 2a and is pressed towards the lower conveying belt 661 by means of a spring (not illustrated). The upper and lower conveying belts 661, 662 are drive-coupled with the inlet conveying portion 620 and is driven by the driving motor SM4.

A conveyer tray 670 is for loading the booklet 2a that is discharged from the outlet conveying portion 660. A conveyer belt 671 that moves in the booklet conveying direction upon being driven by a driving motor SM10 is provided at a lower surface of the conveyer tray 670 and performs loading of the booklet 2a by repeating movements by a predetermined amount each time a booklet 2a is discharged. A booklet discharge detecting sensor 664 detects that a booklet 2a has been discharged from the outlet conveying portion 660.

Figure 15:
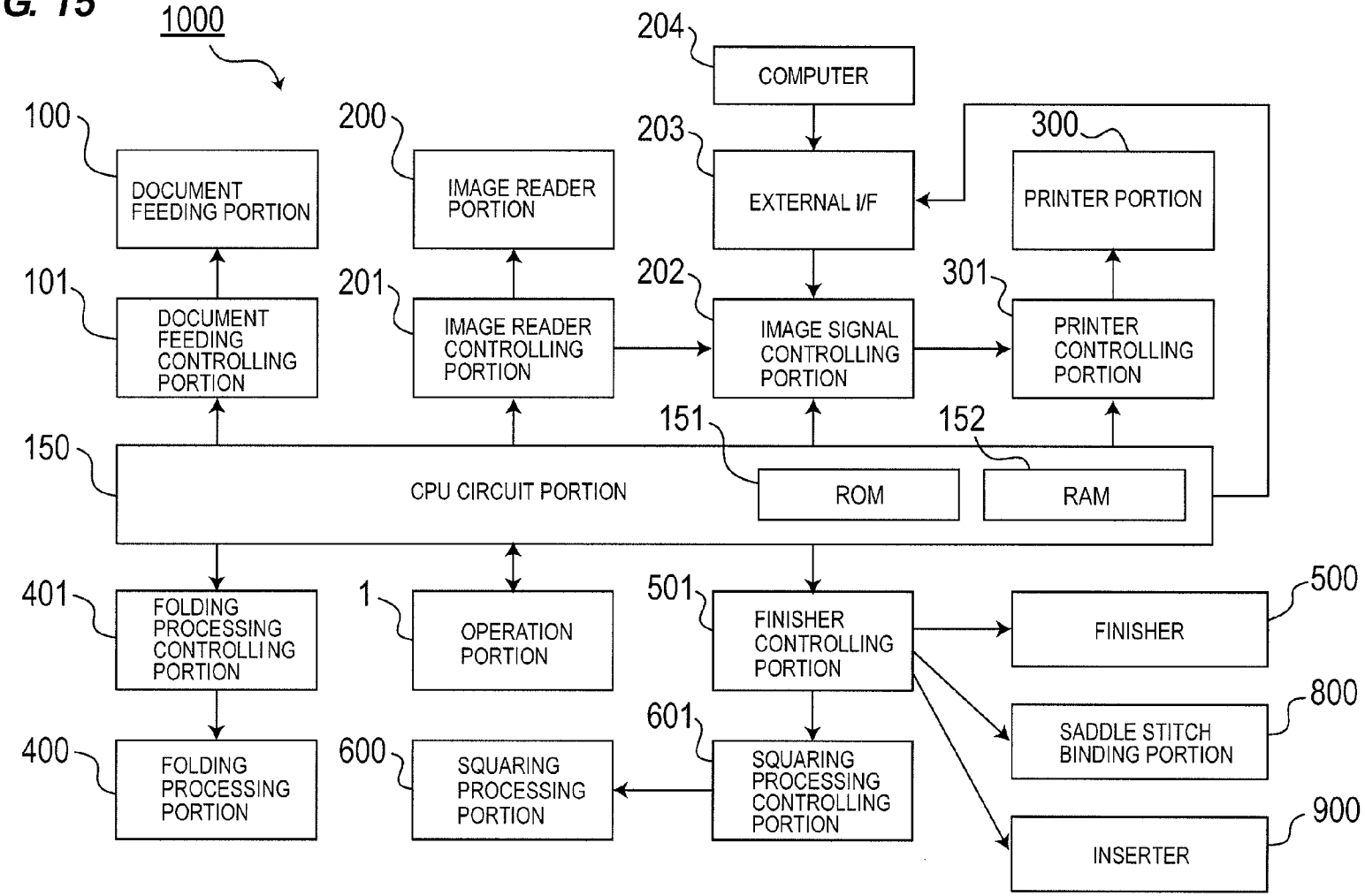
FIG. 15 is a block diagram of a control system of a copying apparatus of the first embodiment of the sheet post-processing apparatus according to the present invention.

FIG. 15 is a block diagram of a control system of a copying apparatus 1000. A CPU circuit portion 150 includes a CPU (Central Processing Unit) (not illustrated). The CPU circuit portion 150 controls the following respective controlling portions according to a control program stored in a ROM (Read Only Memory) 151 and settings of the operation portion 1. The CPU circuit portion 150 controls a document feeding controlling portion 101, an image reader controlling portion 201, an image signal controlling portion 202, a printer controlling portion 301, a folding processing controlling portion 401, a finisher controlling portion 501, and an external I/F (interface) 203. The document feeding controlling portion 101 controls the document feeding portion 100. The image reader controlling portion 201 controls the image reader portion 200. The printer controlling portion 301 controls the printer portion 300. The folding processing controlling portion 401 controls the folding processing portion 400. The finisher controlling portion 501 controls the finisher 500, the saddle stitch binding portion 800 and the inserter 900. The squaring processing controlling portion 601 controls the squaring processing portion 600 based on instructions from the finisher controlling portion 501.

The operation portion 1 includes, among others, a plurality of keys for setting various functions related to image forming and a display portion for displaying setting conditions. The operation portion 1 further outputs key signals to the CPU circuit portion 150 that correspond to operations of the respective keys by the user and displays corresponding pieces of information based on the signals from the CPU circuit portion 150 on the display portion.

RAM (Random Access Memory) 152 is used as a region for temporarily storing control data or as operating regions for calculation accompanying control. The external I/F 203 is an interface between the copying apparatus 1000 and an external computer 204 that develops print data from the computer 204 into bit map images for outputting them as image data to the image signal controlling portion 202. Images of the documents 4 read by an image sensor (not illustrated) are output from the image reader controlling portion 201 to the image signal controlling portion 202. The printer controlling portion 301 outputs image data from the image signal controlling portion 202 to an exposure controlling portion (not illustrated).

FIG. 16 is a block view of a driving system of the squaring processing controlling portion 601 being the changing portion that is arranged to control various driving motors.

Next, the flow of the booklet 2a as well as operations of the respective portions in performing squaring processing operations in the squaring processing portion 600 will be described.

When a saddle stitch mode is selected in the operation portion 1, it can be selected whether a saddle stitch squaring processing mode is to be set or not.

When the saddle stitch squaring processing mode is not selected, the saddle stitched the booklet 2a that have been created in the saddle stitch binding portion 800 are discharged to the conveyer tray 670 by means of the lower conveying belt 611, the transport claws 613, the inlet conveying portion 620 and the outlet conveying portion 660. At this time, the pair of side guides 612, the upper fastening plate 633 and the moving units 656a, 656b are retracted to positions at which they do not intercept the conveying path of the booklet 2a.

Figure 17:
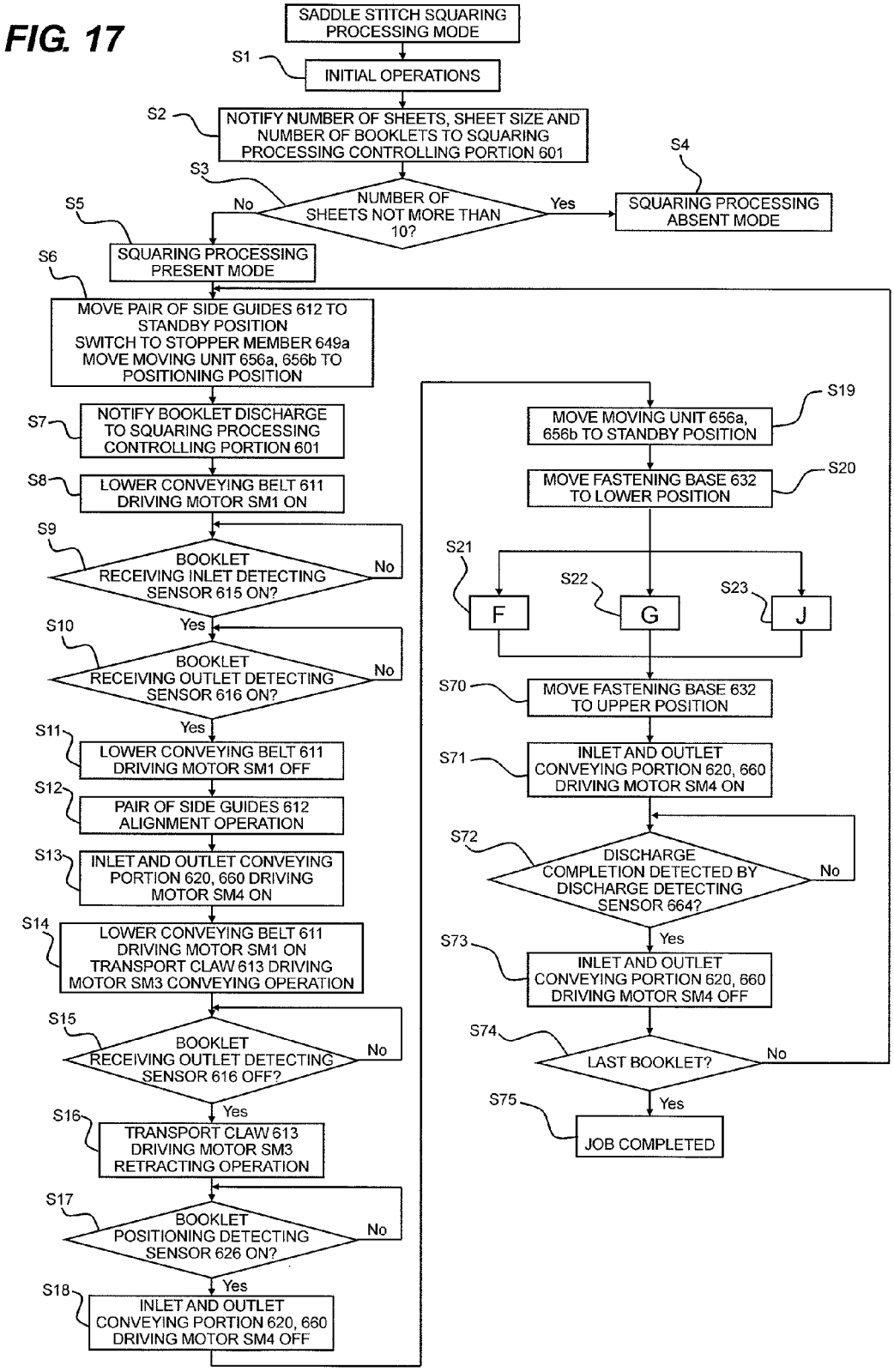
FIG. 17 is a flowchart describing operations of the first embodiment of the sheet post-processing apparatus according to the present invention.
Figure 18:
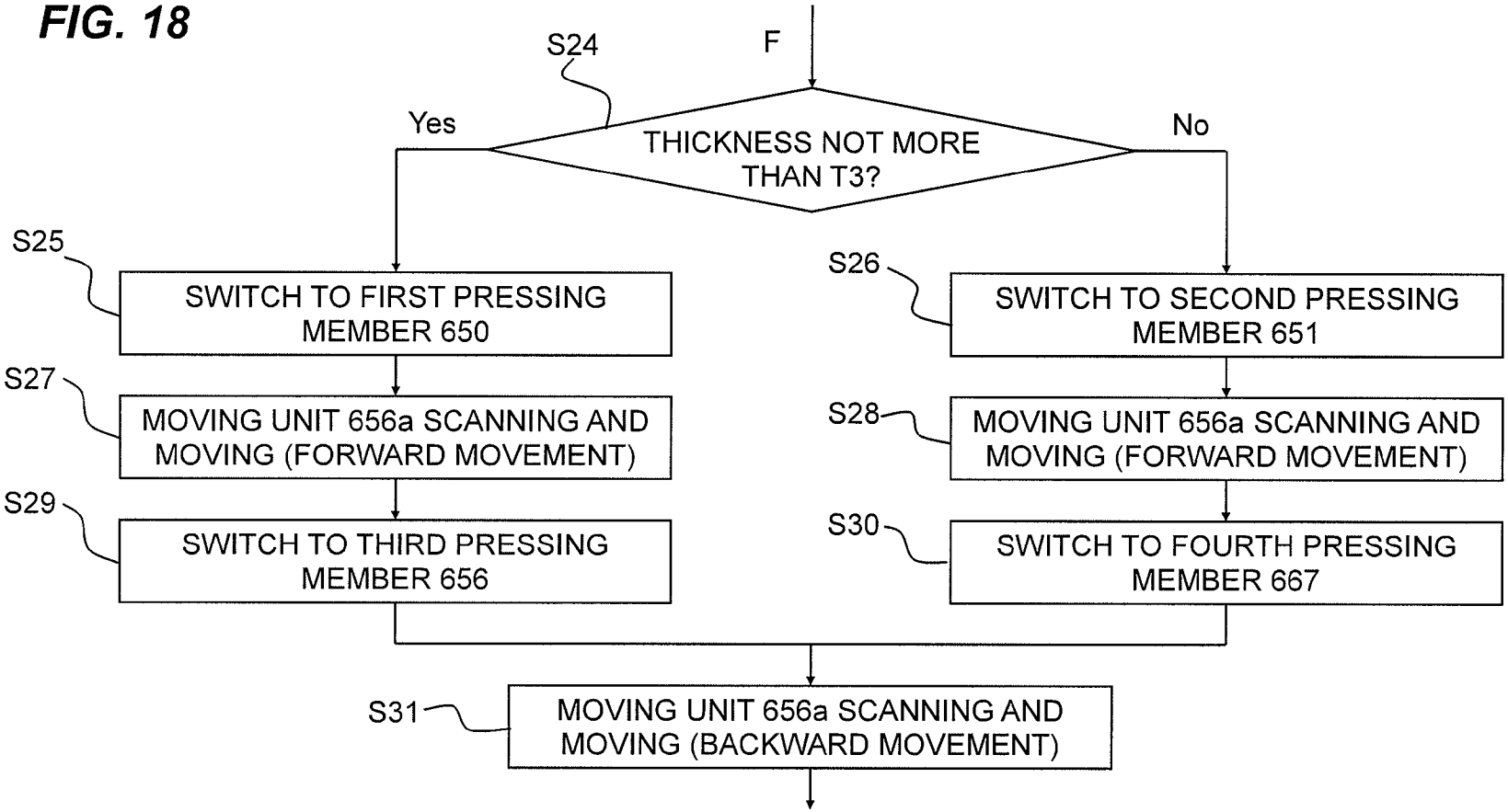
FIG. 18 is a flowchart describing operations of the first embodiment of the sheet post-processing apparatus according to the present invention.

Operations will now be described in details that are performed upon selecting the saddle stitch squaring processing mode. FIGS. 17 and 18 are flowcharts illustrating operational flows when the saddle stitch squaring processing mode is selected.

When the saddle stitch squaring processing mode is selected, the squaring processing portion 600 performs initial operations as indicated in step S1 of FIG. 17. Here, during initial operations, the pair of side guides 612 is moved to an original position, the transport claws 613 are moved to the reference position, and the fastening base 632 is moved to the upper position and detected by the upper dead center detecting sensor 639. Further, the moving units 656a, 656b are moved to the reference position and detected by the reference position detecting sensors 658a, 658b, and the switching unit 657 is moved to the reference position and detected by the reference position detecting sensor 659 as illustrated in FIG. 5. Upon completion of the initial operations, the job proceeds to step S2. In step S2, prior to discharge of the booklet 2a to the booklet receiving portion 610 of the squaring processing portion 600 by means of the second pair of folding and conveying rollers 812a, 812b, the squaring processing controlling portion 601 is notified of the number of sheets 2 of the booklet 2a, the sheet size, and the number of booklets 2a to be created. In step S3, the squaring processing controlling portion 601 determines whether the notified number of sheets 2 of the booklet 2a is not more than 10. When it has been determined in step S3 that the number of sheets 2 of the booklet 2a is not more than 10, the job proceeds to step S4. In step S4, a squaring processing absent mode is selected. When the number of sheets 2 of the booklet 2a is not less than 11 in step S3, the job proceeds to step S5 and the squaring processing present mode is selected.

Next, when the number of sheets 2 of the booklet 2a is not less than 11 and the squaring processing present mode is selected, the pair of side guides 612 provided on both sides of the booklet conveying path of the booklet receiving portion 610 is moved to the standby position according to the booklet size in step S6. Simultaneously therewith, it is switched to the stopper member 649a by the switching unit 657, and the moving units 656*a*, 656*b* move to the booklet positioning position. The booklet positioning position varies according to sizes of the booklet 2*a*. The booklet 2*a* will not rotate when the spine 2*a*1 abut the stopper members 649*a*, 649*b* but set to positions at which the spine 2*a*1 of the booklet 2*a* is maintained parallel to the moving direction of the moving units 656*a*, 656*b*.

Figure 19A:
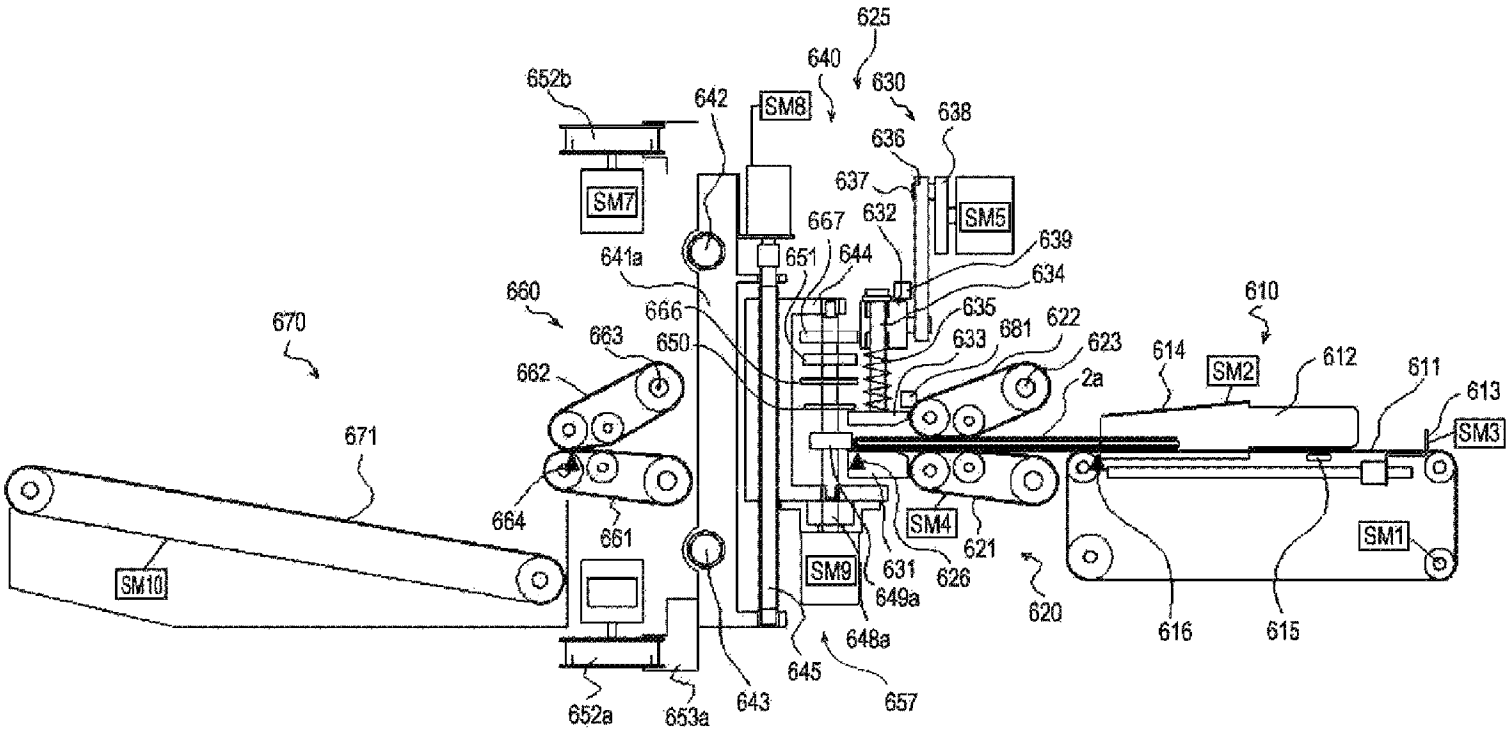
FIG. 19A is a sectional explanatory view illustrating a condition in which the spine of the booklet is abutted against a stopper member in the first embodiment.

Next, in step S7, upon receiving a booklet discharge notification from the saddle stitch binding portion 800, the lower conveying belt 611 is rotated by the driving motor SM1 (step S8) for conveying the booklet 2*a*. Upon detecting a booklet 2*a* containing a folded bundle of sheets 2 by means of the booklet receiving inlet detecting sensor 615 and the booklet receiving outlet detecting sensor 616 (steps S9, S10), delivery of the booklet 2*a* is once terminated (step S11). Thereafter, the pair of side guides 612 performs alignment operations by means of the driving motor SM12 (step S12). Thereafter, the inlet conveying portion 620 and the outlet conveying portion 660 are driven by the driving motor SM4 (step S13), and conveyance of the booklet 2*a* is restarted by the transport claws 613 disposed on the upstream side in the booklet conveying direction of the booklet receiving portion 610 and the lower conveying belt 611 (step S14). The transport claws 613 are driven by the driving motor SM13. When discharge of a booklet 2*a* is detected by the booklet receiving outlet detecting sensor 616 (step S15), the transport claws 613 retract to the upstream side in the booklet conveying direction (step S16). When the booklet 2*a* conveyed by the inlet conveying portion 620 is detected by the booklet positioning detecting sensor 626 (step S17), driving of the inlet conveying portion 620 is terminated (step S18). At this time, as illustrated in FIG. 19A, the spine 2*a*1 of the booklet 2*a* abuts the stopper members 649*a*, 649*b* and is positioned at a position at which they do not bulge from the end portions 631*a*, 633*a* of the upper and lower fastening plates 631, 633 on the downstream side in the booklet conveying direction. Next, the moving units 656*a*, 656*b* are moved to the standby position that is located away from between the upper and lower fastening plates 631, 633 (retracted position not interfering the upper and lower fastening plates 631, 633) (step S19). Then, the fastening base 632 is moved to the lower position by the driving motor SM5 (step S20) and the booklet 2*a* is pressed and held by the upper and lower fastening plates 631, 633.

Next, a flow F indicated by step S21 in FIG. 17 is illustrated in FIG. 18. From the flow F of FIG. 18, in step S24, the position of the upper fastening plate 633 with the booklet 2*a* being in a pressed and held condition is detected by the booklet thickness detection sensor 681 to thereby determine the thickness of the booklet 2*a*. In step S24, when the thickness of the booklet 2*a* is in a range of the above-mentioned T2 to T3 (T2<T3), that is, not more than T3, the job proceeds to step S25 and it is switched to the first pressing member 650 (step S25). In step S24, when the thickness of the booklet 2*a* is in a range of the above-mentioned T4 to T5 (T4<T5), that is, larger than T3, the job proceeds to step S26 and it is switched to the second pressing member 651 (step S26). In this respect, the relationship of the thicknesses of the booklet 2*a* is given by {T2<T3<T4<T5}.

Figure 19B:
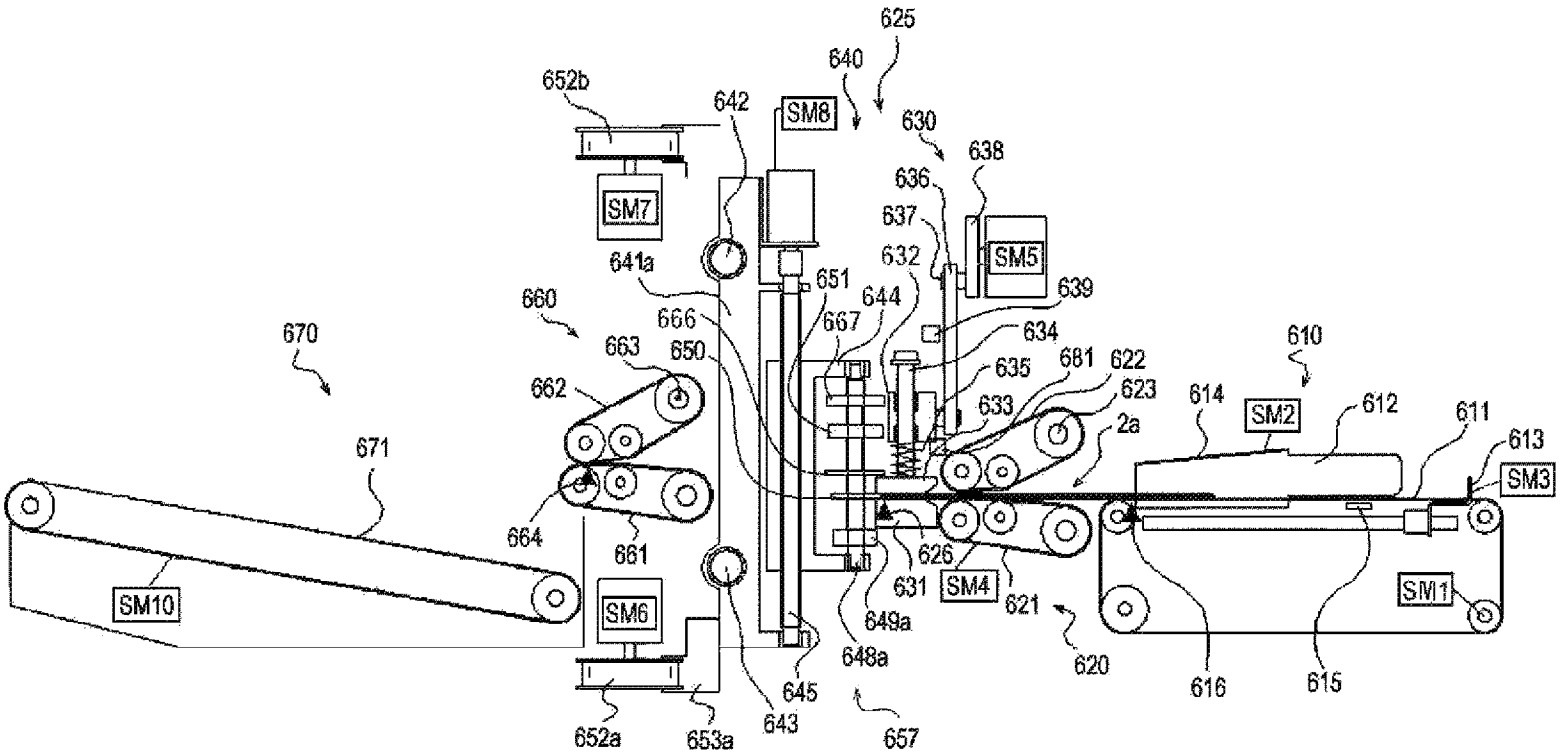
FIG. 19B is a sectional explanatory view illustrating a condition in which the spine of the booklet is pressed by a first pressing member in the first embodiment.
Figure 19C:
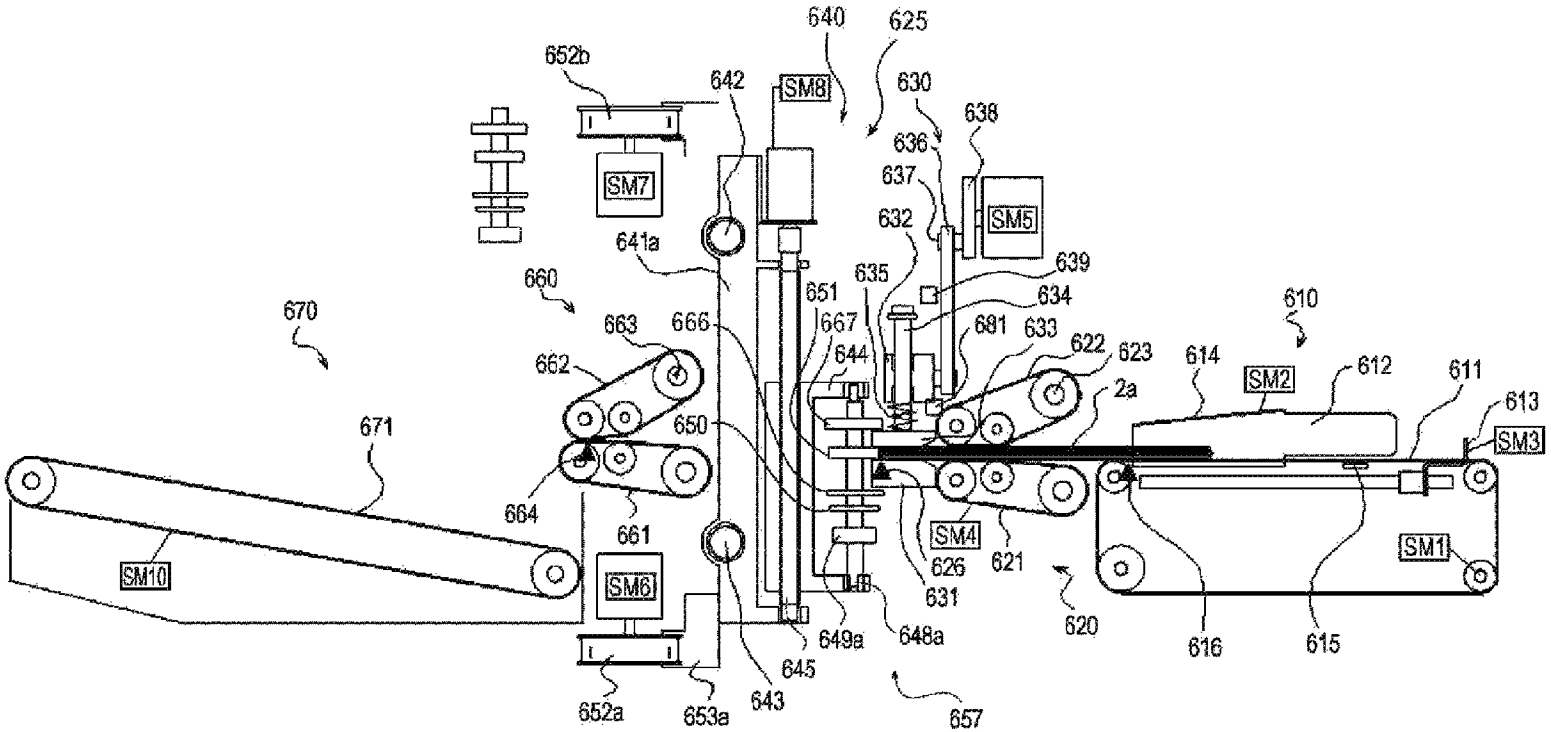
FIG. 19C is a sectional explanatory view illustrating a condition in which the spine of the booklet is abutted by a second pressing member having a different outer diameter and height in the first embodiment.

The moving unit 656*a* is then moved to the forward movement direction A1 (steps S27, 28) and squaring processes of the spine 2*a*1 of the booklet 2*a* is performed. FIG. 19B illustrates a view in which squaring processes are performed by the first pressing member 650 and FIG. 19C illustrates a view in which squaring processes are performed by the second pressing member 651. After moving the moving unit 656*a* to the opposite side end of the booklet 2*a*, it is switched to the third pressing member 666 if the currently selected pressing member is the first pressing member 650 (step S29). It is switched to the fourth pressing member 667 if the currently selected pressing member is the second pressing member 651 (step S30). The moving unit 656*a* is then moved to the backward movement direction A2 that is a direction opposite to the forward moving direction A1 (step S31) whereupon squaring processes of the spine 2*a*1 of the booklet 2*a* is performed.

When the moving unit 656*a* runs and moves in the forward movement direction A1 when performing a forward movement and the pressing member presses and moves along the spine 2*a*1 of the booklet 2*a*, wrinkles C are generated. At this time, the diameter D of the pressing member is set to be large when switching the moving direction of the moving unit 656*a* to the backward moving direction A2. With this arrangement, the pressing position 3 is moved from the position when a forward movement to the position when a backward movement, and the distance P from the spine 2*a*1 in the pressing direction prior to squaring of the spine 2*a*1 of the booklet 2*a* to the pressing position 3 is made large. Moreover, by pressing and moving in a direction opposite to that when performing a forward movement along the spine 2*a*1 of the booklet 2*a* when performing a backward movement, it is possible to return sheets when performing a backward movement that have been pushed out when forward movement. No wrinkles C will accordingly remain on the back portion of the booklet 2*a* even if squaring is performed at the predetermined pressing position 3. It is thus possible to create the booklet 2*a* of favorable appearance. In addition, the diameter D of the pressing member is changed when performing a backward movement. With this arrangement, it is possible to change the distance P from the spine 2*a*1 in the pressing direction prior to squaring processes to the pressing position 3. It is therefore possible to obtain a stable pressing position 3, and the shape of the squared booklet 2*a* can be stabilized so that it is possible to create the booklet 2*a* of favorable appearance.

When the forward and backward movements are completed by running and moving the moving unit 656*a*, the fastening base 632 moves to the upper position (step S70 in FIG. 17) and the upper and lower fastening plates 631, 633 are separated from each other. The outlet conveying portion 660 is driven by the driving motor SM4 (step S71), and the booklet 2*a* that has been conveyed by the outlet conveying portion 660 is discharged to the conveyer tray 670. When the discharged booklet 2*a* is detected by the booklet discharge detecting sensor 664 (step S72), driving of the outlet conveying portion 660 is terminated (step S73). The booklets 2*a* that are discharged to the conveyer tray 670 are sequentially stacked. In step S74, it is determined whether the discharged booklet 2*a* is the last booklet 2*a*, and when the discharged booklet 2*a* is not the last booklet 2*a*, the job returns to step S6, and when it is the last booklet 2*a*, the job is terminated (step S75).

While the booklet 2*a* that is created by the saddle stitch binding portion 800 have been described in the present embodiment as to be the booklet 2*a* containing 1 to 25 two-folded sheets 2, it is possible to vary the number of sheets 2 comprising the booklet 2*a* depending on the performance of the saddle stitch binding portion 800. Further, while the booklet 2*a* to be squared have been described as to be the booklet 2*a* having not less than 11 sheets 2, it is also possible to vary the number of sheets 2 depending on basis weights and thicknesses of the media, and the present invention is not to be limited at all. The present embodiment has been further described in that discrimination is made between two cases depending on the thicknesses of the booklet 2*a* to be squared wherein squaring processes are performed using first to fourth pressing members 650, 651, 666, 667 of four different heights H and diameters D. It is further possible to increase the types of pressing members to be used by further diversifying the case discriminations, and the present invention is not to be limited at all. Further, while the thicknesses of the booklet 2*a* have been discriminated upon detection using the booklet thickness detecting sensor 681, it is also possible to perform case discriminations based on conditions such as basis weights of media, thicknesses or numbers of sheets 2 that might determine the thicknesses of the booklet 2*a*.

Second Embodiment

In the first embodiment, a method in which it is switched to a pressing member of a different diameter D has been exemplified as a method for changing the distance P from the spine 2*a*1 in the pressing direction prior to squaring to the pressing position 3 when switching the forward moving direction. In the present embodiment, positions of central shafts of the pressing members with respect to the booklet 2*a* are changed without switching between pressing members.

Figure 20:
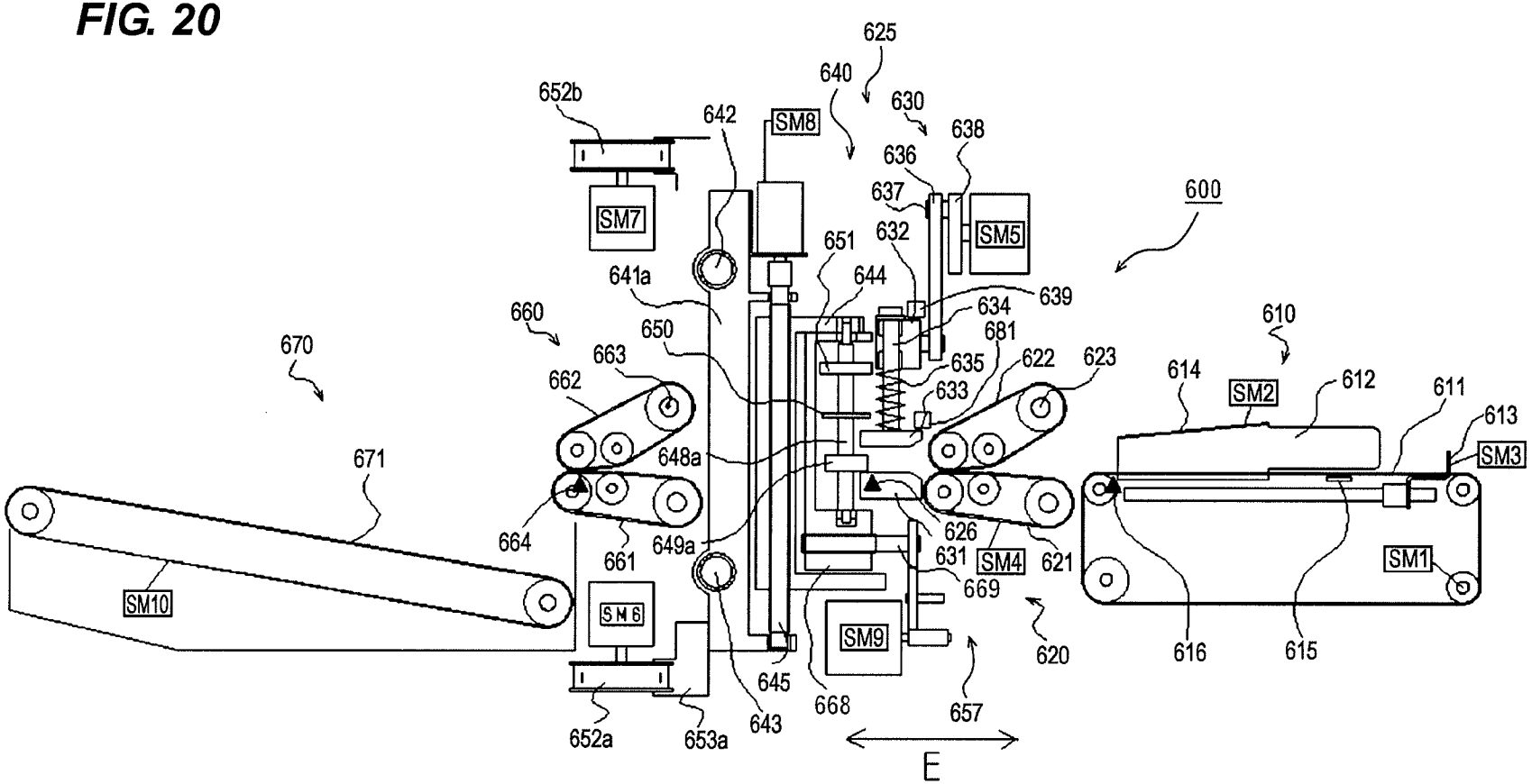
FIG. 20 is a sectional explanatory view illustrating an arrangement of a second embodiment of the sheet post-processing apparatus according to the present invention.
Figure 21:
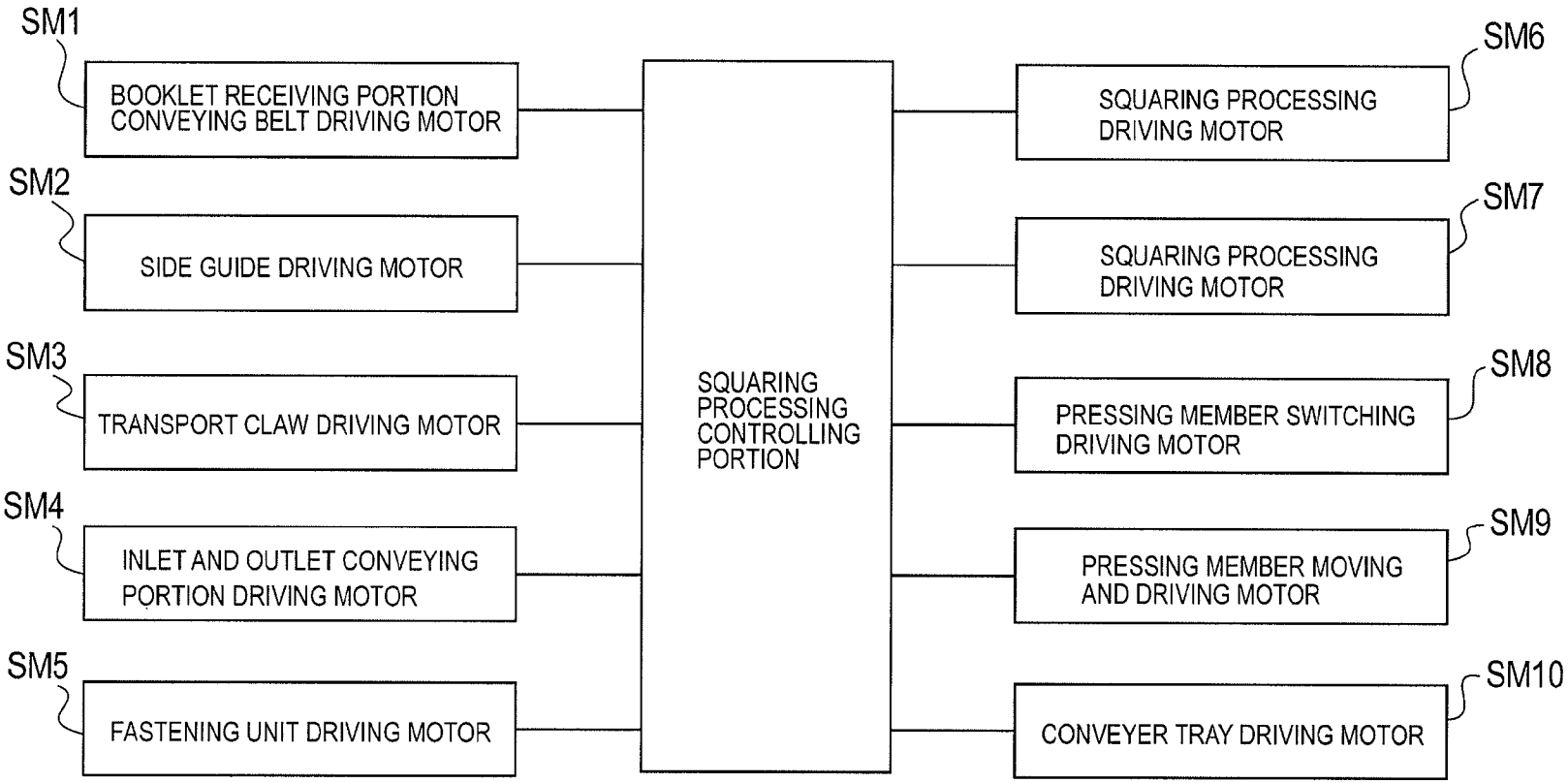
FIG. 21 is a block diagram of a driving system of the second embodiment of the sheet post-processing apparatus according to the present invention.

FIG. 20 is an enlarged view of the squaring processing portion 600 according to the present embodiment, and FIG. 21 is a block view of a driving system of the squaring processing controlling portion 601 that is to be the changing portion in the present embodiment. A pressing member moving and driving motor SM9 is a driving motor for moving the first and second pressing members 650, 651 that are to be the pressing unit in the pressing direction. With the pressing member moving and driving motor SM9 being driven upon being controlled by the squaring processing and controlling portion 601, a pressing member position slide screw 669 is rotated via a gear train. A pressing member position moving base 668 can move along a slide shaft (not illustrated) in the direction of arrow E in FIG. 20 which is to be the pressing direction by means of the pressing member position slide screw 669. With this arrangement, the squaring processing controlling portion 601 that is to be the changing portion can change positions of the first and second pressing members 650, 651 being the pressing unit in the pressing direction for changing the pressing position 3.

Figure 22:
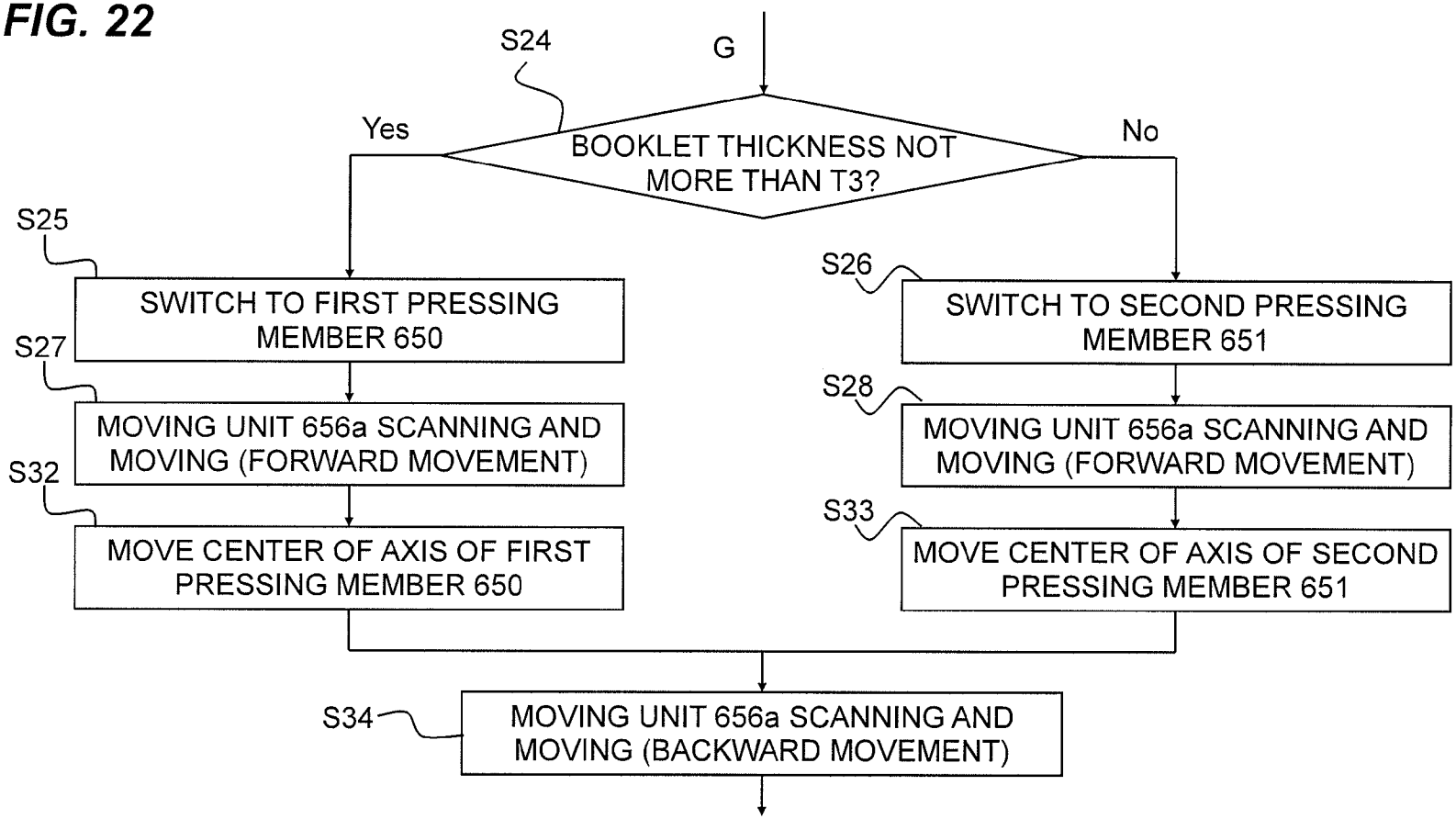
FIG. 22 is a flowchart describing operations of the second embodiment of the sheet post-processing apparatus according to the present invention.

Next, the flow of the booklet as well as operations of the respective portions in performing squaring processing operations in the squaring processing portion 600 based on the above arrangement will be described. In the flow as indicated in FIG. 17, operations from step S20 to step S70 of the present embodiment differ from those of the first embodiment. Operations of respective portions of the present embodiment that are performed subsequent to step S20 will now be described. In the flow G as indicated in step S22 in FIG. 17, the position of the upper fastening plate 633 in a condition in which a booklet 2*a* is pressed and held is detected by the booklet thickness detecting sensor 681 in step S24 of FIG. 22 whereupon the thickness of the booklet 2*a* is determined. When the thickness of the booklet 2*a* is in the range of T2 to T3 as it has been mentioned above by indicating in FIG. 6, that is, when the thickness of the booklet 2*a* is not more than T3, it is switched to the first pressing member 650 (step S25). Then, when the thickness of the booklet 2*a* is in the range of T4 to T5, that is, when the thickness of the booklet 2*a* is thicker than T3, it is switched to the second pressing member 651 (step S26). The moving unit 656*a* as illustrated in FIG. 5 is then moved to the forward movement direction (steps S27, 28) and squaring processes of the spine 2*a*1 of the booklet 2*a* is performed. After moving the moving unit 656*a* to the opposite side end of the booklet 2*a*, the position of the support shaft 648*a* of the first and second pressing members 650, 651 in the pressing direction is changed (steps S32, S33). Thereafter, the moving unit 656*a* is moved along the spine 2*a*1 of the booklet 2*a* to the backward movement direction that is a direction opposite to the forward moving direction (step S34) whereupon squaring processes of the spine 2*a*1 of the booklet 2*a* is performed.

Third Embodiment

In the present embodiment, the distance in the pressing direction from the spine 2*a*1 of the booklet 2*a* prior to squaring processes by the pressing unit is changed when switching the moving direction of the pressing unit. As a method thereof, the squaring processing controlling portion 601 that is to be the changing portion changes the holding position for the booklet 2*a* by the upper and lower fastening plates 631, 633 that are to be the holding unit for changing the pressing position. That is, the standby position of the booklet 2*a* is changed.

Figure 23:
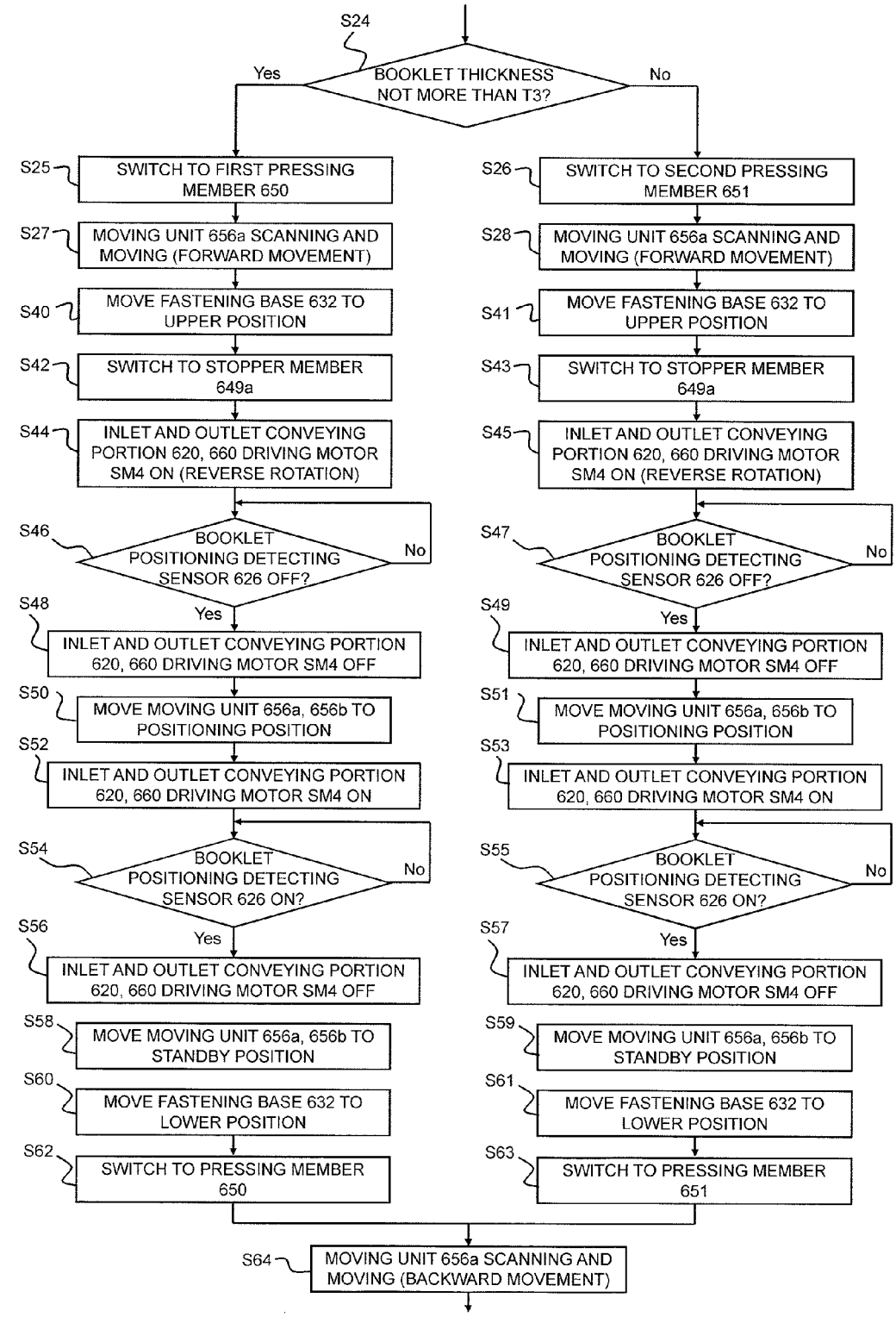
FIG. 23 is a flowchart describing operations of the second embodiment of the sheet post-processing apparatus according to the present invention.
Figure 24A:
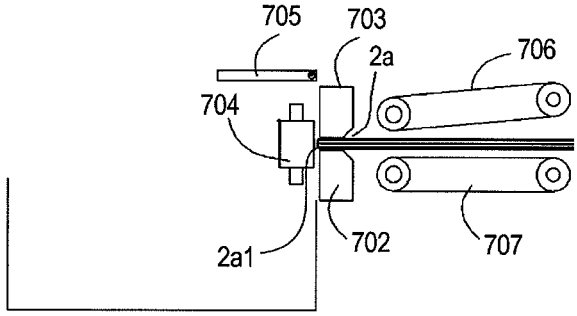
FIG. 24A PRIOR ART
FIGS. 24A and 24B are views for describing the conventional art.
Figure 24B:
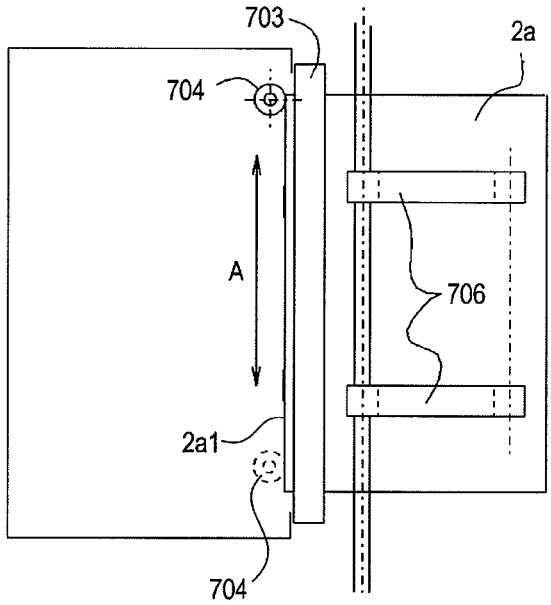
FIG. 24B PRIOR ART
Figure 24C:
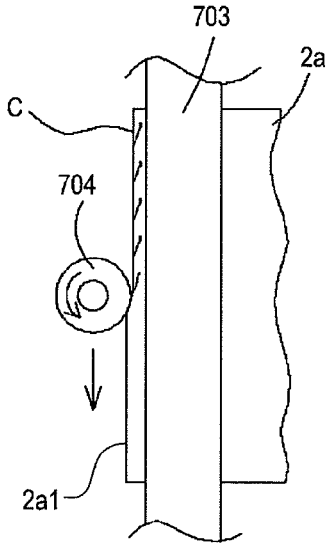
FIG. 24C PRIOR ART
FIG. 24C is a view describing issues of the conventional art.

In the flow J as indicated in step S23 of FIG. 17, operations from steps S20 to S70 of the present embodiment differ from those of the first embodiment. Operations of respective portions of the present embodiment that are performed subsequent to step S20 will now be described with reference to FIG. 23. In step S24 of FIG. 23, the position of the upper fastening plate 633 that is in a condition of pressing and holding the booklet 2*a* is detected by the booklet thickness detecting sensor 681, whereby the thickness of the booklet 2*a* is determined (step S24). When the thickness of the booklet 2*a* is in the range of T2 to T3 as it has been mentioned above by indicating in FIG. 6, that is, when the thickness of the booklet 2*a* is not more than T3, it is switched to the first pressing member 650 (step S25). Then, when the thickness of the booklet 2*a* is in the range of T4 to T5, that is, when the thickness is thicker than T3, it is switched to the second pressing member 651 (step S26).

The moving unit 656*a* as illustrated in FIG. 5 is then moved to the forward movement direction (steps S27, 28) and squaring processes of the spine 2*a*1 of the booklet 2*a* is performed. After moving the moving unit 656*a* to the opposite side end of the booklet 2*a*, the fastening base 632 is moved to the upper position (steps S40, S41), and the first pressing member 650 and the second pressing member 651 are switched to the stopper member 649*a* (step S42, S43).

With the driving motor SM4 rotating in the reverse direction, the inlet conveying portion 620 and the outlet conveying portion 660 are driven to rotate reversely (steps S44, S45). It is then determined by the booklet position detecting sensor 626 whether a booklet 2*a* is detected (steps S46, S47), and when no booklet 2*a* is detected anymore, driving of the inlet conveying portion 620 and the outlet conveying portion 660 is terminated (steps S48, S49). Then, the moving units 656*a*, 656*b* as illustrated in FIG. 5 are moved to the positioning position (steps S50, S51), and upon completion of moving, driving of the inlet conveying portion 620 and the outlet conveying portion 660 is restarted (steps S52, S53).

It is determined whether a booklet 2*a* that is conveyed by the inlet conveying portion 620 is detected by the booklet positioning detecting sensor 626 (steps S54, S55), and when a booklet 2*a* is detected by the booklet positioning detecting sensor 626, driving of the inlet conveying portion 620 is terminated (steps S56, S57). Next, the moving units 656*a*, 656*b* as illustrated in FIG. 5 are moved to the standby position that is a position separated from between the upper and lower fastening plates 631, 633 (a position at which the moving units 656*a*, 656*b* do not interfere the upper and lower fastening plates 631, 633) (steps S58, S59). The fastening base 632 is then moved to the lower position by the driving motor SM5 (steps S60, S61), and the booklet 2*a* is pressed and held by the upper and lower fastening plates 631, 633. At this time, the holding position of the booklet 2*a* by the upper and lower fastening plates 631, 633 is changed to a position that is closer to the end portions 631*a*, 633*a* of the upper and lower fastening plates 631, 633 on the downstream side in the booklet conveying direction when compared to the position when performing a forward movement.

Next, the stopper member 649*a* is switched to the first pressing member 650 and the second pressing member 651, respectively (steps S62, S63). Thereafter, the moving unit 656*a* as illustrated in FIG. 5 is moved along the spine 2*a*1 of the booklet 2*a* to the backward movement direction that is a direction opposite to the forward moving direction (step S64) whereupon squaring processes of the spine 2*a*1 of the booklet 2*a* is performed.

Fourth Embodiment

In the first embodiment, the stopper members 649*a*, 649*b* enter into the interior of the upper and lower fastening plates 631, 633. The booklet 2*a* is then positioned at a position at which the booklet 2*a* does not project from the end portions 631*a*, 633*b* of the upper and lower fastening plates 631, 633 on the downstream side of the booklet conveying direction. Alternatively, as mentioned above in connection with the conventional art, the spine 2*a*1 of the booklet 2*a* may project from the end portions 631*a*, 633*a* of the upper and lower fastening plates 631, 633 on the downstream side in the booklet conveying portion. By moving the upper fastening plate 633 downward while making the spine 2*a*1 of the booklet 2*a* project from the end portions 631*a*, 633*a* of the upper and lower fastening plates 631, 633 on the downstream side in the booklet conveying direction, it is possible to press and hold the booklet 2*a* from above and below by means of the upper and lower fastening plates 631, 633. Even if the spine 2*a*1 of the booklet 2*a* projects out, the pressing position is changed from the position for a forward movement to the position for a backward movement as in the conventional art. With this arrangement, the distance in the pressing direction from the spine 2*a*1 of the booklet 2*a* prior to squaring processing by the pressing unit to the pressing position is made large. Also in this case, when the moving direction of the moving unit 656*a* when pressing is the same direction, wrinkles C will be generated at the periphery of the holding portion. However, the pressing position is moved from the position when a forward movement to the position when a backward movement, similar to the first embodiment. With this arrangement, the distance in the pressing direction from the spine 2*a*1 of the booklet 2*a* prior to squaring processing by the pressing unit to the pressing position is made large. Further, when the moving direction of the moving unit 656*a* when pressing during a forward movement is opposite to that during a backward movement, it is possible to return sheets of the booklet 2*a* proximate of the surface backwards when performing pressing and moving. Accordingly, no wrinkles will remain in the periphery of the holding portion so that the same effects as those obtained when the spine 2*a*1 of the booklet 2*a* is not made to project from the end portions 631*a*, 633*a* of the upper and lower fastening plates 631, 633 on the downstream side in the booklet conveying direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-009840, filed Jan. 20, 2010, which is hereby incorporated by reference herein in its entirety.

What is claimed is:

1. A sheet post-processing apparatus comprising:

a holding unit that holds a booklet containing folded sheets;

a pressing unit having a pressing surface that presses a spine of the booklet held by the holding unit in a pressing direction perpendicular to a thickness direction of the booklet to deform the spine into a square shape;

a moving unit that moves the pressing unit forward and backward along the spine while the pressing surface of the pressing unit is pressing the spine; and a changing portion that changes a pressing position of the pressing surface at which the pressing surface presses the spine in the pressing direction, wherein the changing portion changes the pressing position so that, when squaring of the spine is performed while the pressing unit reciprocates along the spine of the booklet by the moving unit, a distance in the pressing direction between a top of the spine prior to pressing by the pressing surface and the pressing position is changed such that the distance during a backward movement of reciprocating the pressing unit becomes larger than the distance during a forward movement.

2. The sheet post-processing apparatus according to claim 1, wherein the pressing unit includes a plurality of pressing members of which pressing positions of each pressing surface are different, and a switching unit which switches between the plurality of pressing members, and wherein the changing portion changes the pressing position by switching the pressing members.

3. The sheet post-processing apparatus according to claim 2, wherein the plurality of pressing members is a plurality of rotating members having respectively different diameters, and wherein the changing portion changes the pressing position in the pressing direction by switching the rotating members.

4. The sheet post-processing apparatus according to claim 1, wherein the changing portion changes the pressing position by changing a position of the booklet in the pressing direction.

5. The sheet post-processing apparatus according to claim 1, wherein the changing portion changes the pressing position by changing a position of the pressing unit in the pressing direction.

6. The sheet post-processing apparatus according to claim 1, wherein the holding unit holds the spine of the folded booklet without the spine projecting out from a holding surface of the holding unit in the pressing direction.

7. The sheet post-processing apparatus according to claim 1, comprising a folding processing portion, provided upstream of the holding unit in a booklet conveying direction, which stacks and folds a plurality of sheets into two.

8. An image forming apparatus comprising:

an image forming portion which forms an image on a sheet; and a sheet post-processing apparatus which processes the sheet with the image being formed, wherein the sheet post-processing apparatus includes:

a holding unit that holds a booklet containing folded sheets;

a pressing unit having a pressing surface that presses a spine of the booklet held by the holding unit in a pressing direction perpendicular to a thickness direction of the booklet to deform the spine into a square shape;

a moving unit that moves the pressing unit forward and backward along the spine while the pressing surface of the pressing unit is pressing the spine; and a changing portion that changes a pressing position of the pressing surface at which the pressing surface presses the spine in the pressing direction, wherein the changing portion changes the pressing position so that, when squaring of the spine is performed while the pressing unit reciprocates along the spine of the booklet by the moving unit, a distance in the pressing direction between a top of the spine prior to pressing by the pressing surface and the pressing position is changed such that the distance during a backward movement of reciprocating the pressing unit becomes larger than the distance during a forward movement.

9. The image forming apparatus according to claim 8, wherein the pressing unit includes a plurality of pressing members of which pressing positions of each pressing surface are different, and a switching unit which switches between the plurality of pressing members, and wherein the changing portion changes the pressing position by switching the pressing members.

10. The image forming apparatus according to claim 9, wherein the plurality of pressing members is a plurality of rotating members having respectively different diameters, and wherein the changing portion changes the pressing position by switching the rotating members.

11. The image forming apparatus according to claim 8, wherein the changing portion changes the pressing position by changing a position of the booklet in the pressing direction.

12. The image forming apparatus according to claim 8, wherein the changing portion changes the pressing position by changing a position of the pressing unit in the pressing direction.

13. The image forming apparatus according to claim 8, wherein the holding unit holds the spine of the folded booklet without the spine projecting out from a holding surface of the holding unit in the pressing direction.

14. The image forming apparatus according to claim 8, wherein the sheet post-processing apparatus includes a folding processing portion, provided upstream of the holding unit in a booklet conveying direction, which stacks and folds a plurality of sheets into two.

* * * * *